US008789337B2

(12) United States Patent
Aston et al.

(10) Patent No.: US 8,789,337 B2
(45) Date of Patent: Jul. 29, 2014

(54) FOUNDATION SYSTEM FOR BRIDGES AND OTHER STRUCTURES

(75) Inventors: Scott D. Aston, Liberty Township, OH (US); Michael G. Carfagno, Dayton, OH (US); Philip A. Creamer, Springboro, OH (US)

(73) Assignee: Contech Engineered Solutions LLC, West Chester, OH (US)

( * ) Notice: Subject to any disclaimer, the term of this patent is extended or adjusted under 35 U.S.C. 154(b) by 26 days.

(21) Appl. No.: 13/541,043

(22) Filed: Jul. 3, 2012

(65) Prior Publication Data

US 2013/0008108 A1 Jan. 10, 2013

Related U.S. Application Data

(60) Provisional application No. 61/637,922, filed on Apr. 25, 2012, provisional application No. 61/505,564, filed on Jul. 8, 2011.

(51) Int. Cl.
*E02D 27/00* (2006.01)

(52) U.S. Cl.
USPC ..... 52/742.1; 52/742.13; 52/742.14; 52/745.21; 52/295; 52/293.1

(58) Field of Classification Search
CPC ..... E01F 5/005; E01D 1/00; E01D 4/00; E02D 27/00; E02D 27/02; E02D 27/016
USPC ..... 52/292, 293.1, 294, 742.1, 742.13, 52/742.14, 745.21
See application file for complete search history.

(56) References Cited

U.S. PATENT DOCUMENTS

| | | | |
|---|---|---|---|
| 109,886 | A | 12/1870 | Freeman |
| 567,653 | A | 9/1896 | Parker |
| 1,074,268 | A | 9/1913 | Kelly et al. |
| 1,184,634 | A | 5/1916 | Duerrwachter |

(Continued)

FOREIGN PATENT DOCUMENTS

| | | |
|---|---|---|
| EP | 0244890 | 11/1987 |
| EP | 0568799 | 11/1993 |
| FR | 2330818 | 6/1977 |
| WO | WO 92/07144 | 4/1992 |

OTHER PUBLICATIONS

International Search Report and Written Opinion; mailed Jul. 17, 2003; PCT/US2012/045353, filed Jul. 3, 2012; 12 pgs.

*Primary Examiner* — Mark Wendell
(74) *Attorney, Agent, or Firm* — Thompson Hine LLP

(57) ABSTRACT

A bridge system is provided that utilizes foundation structures that are formed of the combination of precast and cast-in-place concrete. A method of constructing the combination precast and cast-in-place concrete foundation structures involves receiving at a construction site a precast concrete foundation unit having elongated upright wall members that define a channel therebetween, and multiple upright supports located within the channel; placing the precast concrete foundation unit at a desired use location; delivering concrete into the channel while the precast concrete foundation unit remains at the desired use location; and allowing the concrete to cure-in-place such that the elongated upright wall members are connected to the cured-in-place concrete by reinforcement embedded within both the cured-in-place concrete and the upright wall members. The bridge units may be placed before the pouring step to embed the bottoms of the bridge units in the cast-in-place concrete.

16 Claims, 29 Drawing Sheets

(56) References Cited

U.S. PATENT DOCUMENTS

| | | | | | |
|---|---|---|---|---|---|
| 1,412,615 | A | | 4/1922 | Kammerer et al. | |
| 1,474,808 | A | | 11/1923 | Zucco | |
| 1,784,271 | A | * | 12/1930 | Collins | 405/124 |
| 2,616,149 | A | | 11/1952 | Waller | |
| 3,195,852 | A | | 7/1965 | Lundell | |
| 3,286,972 | A | | 11/1966 | Jackson | |
| 3,397,494 | A | | 8/1968 | Waring | |
| 3,848,377 | A | | 11/1974 | Mori | |
| 4,094,110 | A | | 6/1978 | Dickens et al. | |
| 4,099,360 | A | | 7/1978 | Outram | |
| 4,141,666 | A | | 2/1979 | DeGraff | |
| 4,211,504 | A | | 7/1980 | Sivachenko | |
| 4,318,635 | A | | 3/1982 | Gurtner et al. | |
| 4,558,969 | A | | 12/1985 | FitzSimons | |
| 4,563,107 | A | * | 1/1986 | Peterson | 405/124 |
| 4,687,371 | A | | 8/1987 | Lockwood | |
| 4,797,030 | A | | 1/1989 | Lockwood | |
| 4,817,353 | A | | 4/1989 | Woods et al. | |
| 4,854,775 | A | | 8/1989 | Lockwood | |
| 4,972,641 | A | | 11/1990 | Barrios | |
| 4,972,646 | A | | 11/1990 | Miller et al. | |
| 4,987,707 | A | | 1/1991 | Kiselev et al. | |
| 4,993,872 | A | | 2/1991 | Lockwood | |
| 5,252,002 | A | | 10/1993 | Day | |
| 5,326,191 | A | | 7/1994 | Wilson et al. | |
| 5,505,033 | A | | 4/1996 | Matsuo et al. | |
| 5,524,405 | A | | 6/1996 | Byrd | |
| 5,533,835 | A | | 7/1996 | Angelette | |
| 5,536,113 | A | | 7/1996 | McGregor | |
| 5,586,417 | A | | 12/1996 | Henderson et al. | |
| 5,720,577 | A | | 2/1998 | Sanders et al. | |
| 5,836,717 | A | | 11/1998 | Bernini | |
| D406,902 | S | | 3/1999 | Lockwood | |
| D426,321 | S | | 6/2000 | Lockwood | |
| 6,094,881 | A | | 8/2000 | Lockwood | |
| 6,161,342 | A | | 12/2000 | Barbier et al. | |
| 6,205,717 | B1 | | 3/2001 | Shall et al. | |
| 6,243,994 | B1 | | 6/2001 | Bernini | |
| 6,367,214 | B1 | * | 4/2002 | Monachino | 52/247 |
| 6,408,581 | B2 | * | 6/2002 | Monachino | 52/247 |
| 6,474,907 | B2 | | 11/2002 | Semotiuk et al. | |
| 6,640,505 | B1 | * | 11/2003 | Heierli | 52/86 |
| D484,610 | S | | 12/2003 | Lockwood | |
| 6,719,492 | B1 | | 4/2004 | Heierli | |
| D490,533 | S | | 5/2004 | Lockwood | |
| 6,854,928 | B2 | | 2/2005 | Lockwood | |
| 6,922,950 | B2 | | 8/2005 | Heierli | |
| D511,215 | S | | 11/2005 | Vaia | |
| D511,387 | S | | 11/2005 | Beach | |
| 6,962,465 | B2 | | 11/2005 | Zax et al. | |
| D512,513 | S | | 12/2005 | Wasniak et al. | |
| 6,988,337 | B1 | | 1/2006 | Heierli | |
| D514,706 | S | | 2/2006 | Beach | |
| 7,001,110 | B2 | * | 2/2006 | Lockwood | 405/284 |
| 7,114,305 | B2 | | 10/2006 | Heierli | |
| 7,217,064 | B1 | | 5/2007 | Wilson | |
| 7,305,798 | B1 | | 12/2007 | Heierli | |
| D573,722 | S | | 7/2008 | Lockwood | |
| 7,556,451 | B2 | | 7/2009 | Beach et al. | |
| 7,568,860 | B2 | | 8/2009 | Chiaves | |
| 7,770,250 | B2 | | 8/2010 | Boresi et al. | |
| 2007/0261341 | A1 | | 11/2007 | Lockwood | |
| 2008/0006003 | A1 | | 1/2008 | Skendzic | |

* cited by examiner

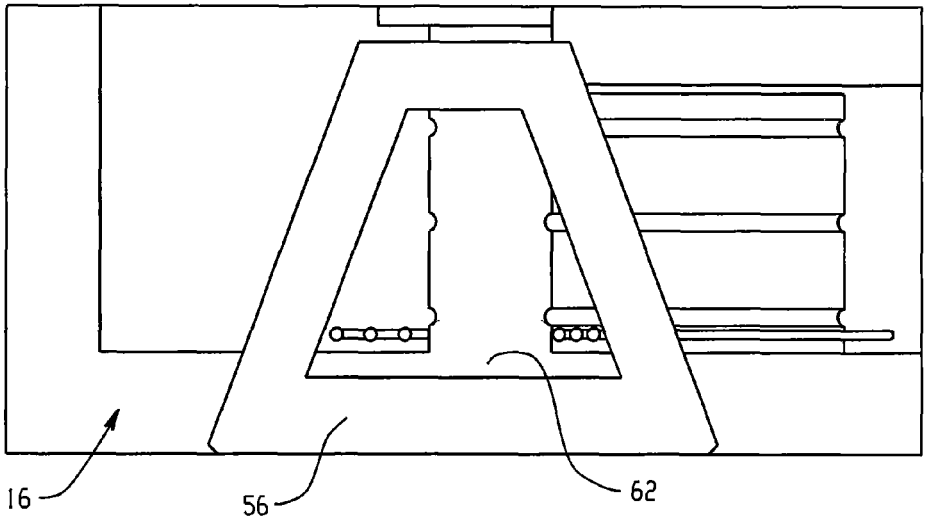
Fig. 11
Fig. 12
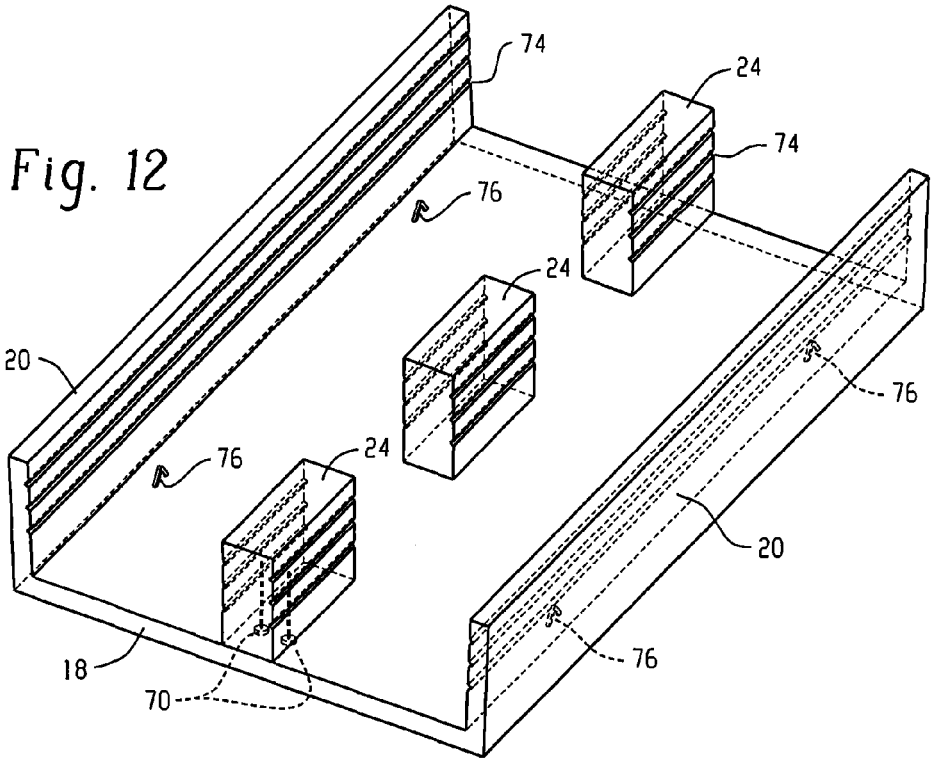

FOUNDATION SYSTEM FOR BRIDGES AND OTHER STRUCTURES

CROSS-REFERENCES

This application claims the benefit of U.S. Provisional Application Ser. No. 61/637,922, filed Apr. 25, 2012 and U.S. Provisional Application Ser. No. 61/505,564, filed Jul. 8, 2011, each of which is incorporated herein by reference.

TECHNICAL FIELD

The present application relates to the general art of structural, bridge and geotechnical engineering, and to the particular field of foundations for overfilled arches and other bridge structures.

BACKGROUND

Overfilled bridge structures are frequently formed of precast or cast-in-place reinforced concrete and are used in the case of bridges to support a first pathway over a second pathway, which can be a waterway, a traffic route, or in the case of other structures, a storage space or the like. The term "overfilled bridge" will be understood from the teaching of the present disclosure, and in general as used herein, an overfilled bridge is a bridge formed of bridge elements or units that rest on a foundation and has soil or the like resting thereon and thereabout to support and stabilize the structure and in the case of a bridge provide the surface of the first pathway.

In the past the bridge units of overfilled bridge structures have been constructed to rest on prepared foundations at the bottom of both sides of the structure. Fill material, at the sides of the arch (backfill material) serves to diminish the outward displacements of the structure when the structure is loaded from above. The foundations previously used have typically been cast-in-place, requiring significant on-site preparation and manufacturing time and labor, making foundation preparation a very weather effected step of the construction process.

A foundation structure, system and method with advantages as to manufacturability, installation and ability to effectively receive and support bridge structures would be desirable.

SUMMARY

As used herein the term "precast" or "precast concrete" as used in reference to a structure or portion of a structure means that the concrete of the structure or portion of the structure was poured and cured to create the structure or portion of the structure prior to delivery of the structure or portion of the structure to a construction site or other installation/use location where the structure or portion of the structure will be installed for use.

As used herein the term "cast-in-place" or "cast-in-place concrete" as used in reference to a structure or portion of a structure means that the concrete of the structure or portion of the structure was poured and cured at the installation/use location of the structure or portion of the structure.

As used herein the term "concrete" means traditional concrete as well as variations such as concrete formulas with plastics/polymers or resins incorporated therein or with fibers or other materials incorporated therein.

In a first aspect, a bridge system includes a first combination precast and cast-in-place concrete foundation structure and a second combination precast and cast-in-place foundation structure. The first combination precast and cast-in-place foundation structure includes a first precast concrete foundation unit having an inner elongated upright wall member and an outer elongated upright wall member spaced apart from the inner elongated upright wall member to define a channel therebetween, and multiple upright supports located within the channel; and cast-in-place concrete within the channel of the first precast concrete foundation unit and tied to each of the inner and outer elongated upright wall members by reinforcement embedded within both the cast-in-place concrete and the inner elongated upright wall member and reinforcement embedded within both the cast-in-place concrete and the outer elongated upright wall member. The second combination precast and cast-in-place concrete foundation structure is spaced apart from the first combination precast and cast-in-place concrete foundation structure and extends substantially parallel thereto, and the second combination precast and cast-in-place concrete foundation structure includes: a second precast concrete foundation unit having an inner elongated upright wall member and an outer elongated upright wall member spaced apart from the inner elongated upright wall member to define a channel therebetween, and multiple upright supports located within the channel; and cast-in-place concrete within the channel of the second precast concrete foundation unit and tied to each of the inner and outer elongated upright wall members of the second precast concrete foundation unit by reinforcement embedded within both the cast-in-place concrete and the inner elongated upright wall member of the second precast concrete foundation unit and reinforcement embedded within both the cast-in-place concrete and the outer elongated upright wall member of the second precast concrete foundation unit. The system includes multiple bridge units, each of the multiple bridge units having a first bottom portion and a second bottom portion spaced apart from the first bottom portion, the first bottom portion supported by the first combination precast and cast-in-place concrete foundation structure and at least partly embedded in the cast-in-place concrete of the first combination precast and cast-in-place concrete foundation structure, and the second bottom portion supported by the second combination precast and cast-in-place concrete foundation structure and at least partly embedded in the cast-in-place concrete of the second combination precast and cast-in-place concrete foundation structure.

In the first aspect, the multiple supports of the first precast concrete foundation unit may substantially align with the multiple supports of the second precast concrete foundation unit.

In the first aspect, each of the multiple supports of the first precast concrete foundation unit may extend laterally between the inner elongated upright wall member and the outer elongated upright wall member of the first precast concrete foundation unit to define multiple spaced apart cells in the channel of the first precast concrete foundation unit, the cast-in-place concrete of the first combination precast and cast-in-place concrete foundation structure located within each cell of the first precast concrete foundation unit, and each of the multiple supports of the second precast concrete foundation unit may extend laterally between the inner elongated upright wall member and the outer elongated upright wall member of the second precast concrete foundation unit to define multiple spaced apart cells in the channel of the second precast concrete foundation unit, the cast-in-place concrete of the second combination precast and cast-in-place concrete foundation structure located within each cell of the second precast concrete foundation unit.

In the first aspect, each of the multiple cells of the first precast concrete foundation unit may be open at both the top and the bottom, and the cast-in-place concrete of the first combination precast and cast-in-place concrete foundation structure may substantially close each cell from top to bottom; and each of the multiple cells of the second precast concrete foundation unit may be open at both the top and the bottom, and the cast-in-place concrete of the second combination precast and cast-in-place concrete foundation structure may substantially close each cell from top to bottom.

In the first aspect, a receiving channel may be located atop each of the multiple supports of the first and second precast concrete foundation units to receive and support the first and second bottom portions of the bridge units.

In the first aspect, the receiving channels may take on various forms, including (i) a recess formed in the supports or a channel member mounted on the supports, (ii) having a U-shape or an L-shape and/or (iii) being entirely within the channel or extending from within the channel to one of the elongated upright walls.

In the first aspect, the cast-in-place concrete at the outer sides of the bottom portions of each bridge unit may have a higher elevation than at the inner sides. Moreover, the cast-in-place concrete at the outer side may be higher than a bottom surface of the bridge unit bottom portion to embed the bottom portion at its outer side, and the cast-in-place concrete at the inner side may be substantially flush with the bottom surface.

In the first aspect, at least some of the multiple supports may include at least one flow opening extending from cell to cell for permitting cast-in-place concrete to flow from one cell through the support to another cell during pouring, the flow opening including cast-in-place concrete therein. Moreover, at least some of the multiple supports may include multiple reinforcement openings extending from cell to cell, each reinforcement opening smaller than the flow opening, and reinforcement may extend through each of the reinforcement openings from cell to cell and include ends embedded in the cast-in-place concrete.

In the first aspect, the combination precast and cast-in-place concrete foundation structures may further include a precast wingwall foundation unit at one end, with reinforcement extending from the precast wingwall foundation unit into to the precast concrete foundation unit and embedded in the cast-in-place concrete. The reinforcement may extend from the precast wingwall foundation unit into the channel of first precast concrete foundation unit. A bottom of the precast wingwall foundation unit may be wider than a top of the precast wingwall foundation unit.

In another aspect, a precast concrete foundation unit for use in constructing a combination precast and cast-in-place concrete foundation structure is provided and includes: a first elongated upright wall member and a second elongated upright wall member spaced apart from the first elongated upright wall member to define a channel therebetween, and multiple upright supports located within the channel, each of the multiple supports extends laterally between the first elongated upright wall member and the second elongated upright wall member of the first precast concrete foundation unit to (i) define multiple spaced apart cells along a length of the channel and (ii) rigidly connect the first elongated upright wall member and the second elongated upright wall member, each of the multiple cells is open at both the top and the bottom, a receiving channel is located atop each of the multiple supports, at least some of the multiple supports include at least one flow opening extending from cell to cell for permitting cast-in-place concrete to flow from one cell through the support to another cell during pouring.

In yet another aspect, a combination precast and cast-in-place concrete foundation structure located at a bridge installation site is provided and includes: a precast concrete foundation unit having an inner elongated upright wall member and an outer elongated upright wall member spaced apart from the inner elongated upright wall member to define a channel therebetween, and multiple upright supports located within the channel; an elongated precast concrete pedestal unit, formed separately from the precast concrete foundation unit and positioned within the channel and extending upwardly out of the channel and above the precast concrete foundation unit, a top surface of the elongated precast concrete pedestal unit including a recess therein or channel member thereon; and cast-in-place concrete within the channel and (i) tied to each of the inner and outer elongated upright wall members by reinforcement embedded within both the cast-in-place concrete and the inner elongated upright wall member and reinforcement embedded within both the cast-in-place concrete and the outer elongated upright wall member and (ii) tied to the elongated precast concrete pedestal unit by reinforcement embedded within both the cast-in-pace concrete and the precast concrete pedestal unit.

In still another aspect, a method of constructing a combination precast and cast-in-place concrete foundation structure involves: receiving at a construction site a first precast concrete foundation unit having a first elongated upright wall member and a second elongated upright wall member spaced apart from the first elongated upright wall member to define a channel therebetween, and multiple upright supports located within the channel; placing the first precast concrete foundation unit at a desired use location of the construction site; delivering concrete into the channel of the first precast concrete foundation unit while the first precast concrete foundation unit remains at the desired use location; and allowing the concrete to cure-in-place such that each of the first and second elongated upright wall members are connected to the cured-in-place concrete by reinforcement embedded within both the cured-in-place concrete and the first elongated upright wall member and reinforcement embedded within both the cured-in-place concrete and the second elongated upright wall member.

In one implementation of the preceding method aspect, each of the multiple supports of the first precast concrete foundation unit extends laterally between the inner elongated upright wall member and the outer elongated upright wall member of the first precast concrete foundation unit to define multiple spaced apart cells in the channel of the first precast concrete foundation unit, and the delivering step involves delivering the concrete into each cell of the first precast concrete foundation unit.

In one implementation of the preceding method aspect, each of the multiple cells of the first precast concrete foundation unit is open at both the top and the bottom, and the cured-in-place concrete substantially closes each cell from top to bottom.

In one implementation of the preceding method aspect, prior to the delivering step one of a precast concrete pedestal unit or a bridge unit is supported at least in part within the channel on the multiple supports, and during the allowing step a bottom portion of the one of the precast concrete pedestal unit or the bridge unit becomes embedded in the cured-in-place concrete.

In one implementation of the preceding method aspect, each of the multiple supports includes a top recess therein or channel member thereon and the one of the precast concrete pedestal unit or the bridge unit is supported by the top recess or channel member.

In one implementation of the preceding method aspect, the top recess or channel member of each of the multiple supports of the first precast concrete foundation unit extends from within the channel to the first elongated upright wall member and during the delivering step the delivered concrete located between the bottom portion and the second elongated upright wall member is set to a first elevation and the delivered concrete located between the bottom portion and the first elongated upright wall member is set to a second elevation that is lower than the first elevation.

In one implementation of the preceding method aspect, the method includes the further steps of: receiving at the construction site a precast concrete wingwall foundation unit; prior to the delivering step, placing the precast concrete wingwall foundation unit at one end of the first precast concrete foundation unit such that reinforcement extends from the precast concrete wingwall unit and into the channel; and as a result of the delivering and allowing steps, the reinforcement that extends from the precast concrete wingwall unit and into the channel becomes embedded in the cured-in-place concrete.

In one implementation of the preceding method aspect, the precast concrete wingwall foundation unit includes a bottom surface and a top surface, the bottom surface wider than the top surface.

BRIEF DESCRIPTION OF THE DRAWINGS

FIGS. 9-11 show aspects of a wingwall foundation;

FIGS. 12 and 13 depict an alternative arrangement for supports of a foundation unit;

DETAILED DESCRIPTION

Figure 1:
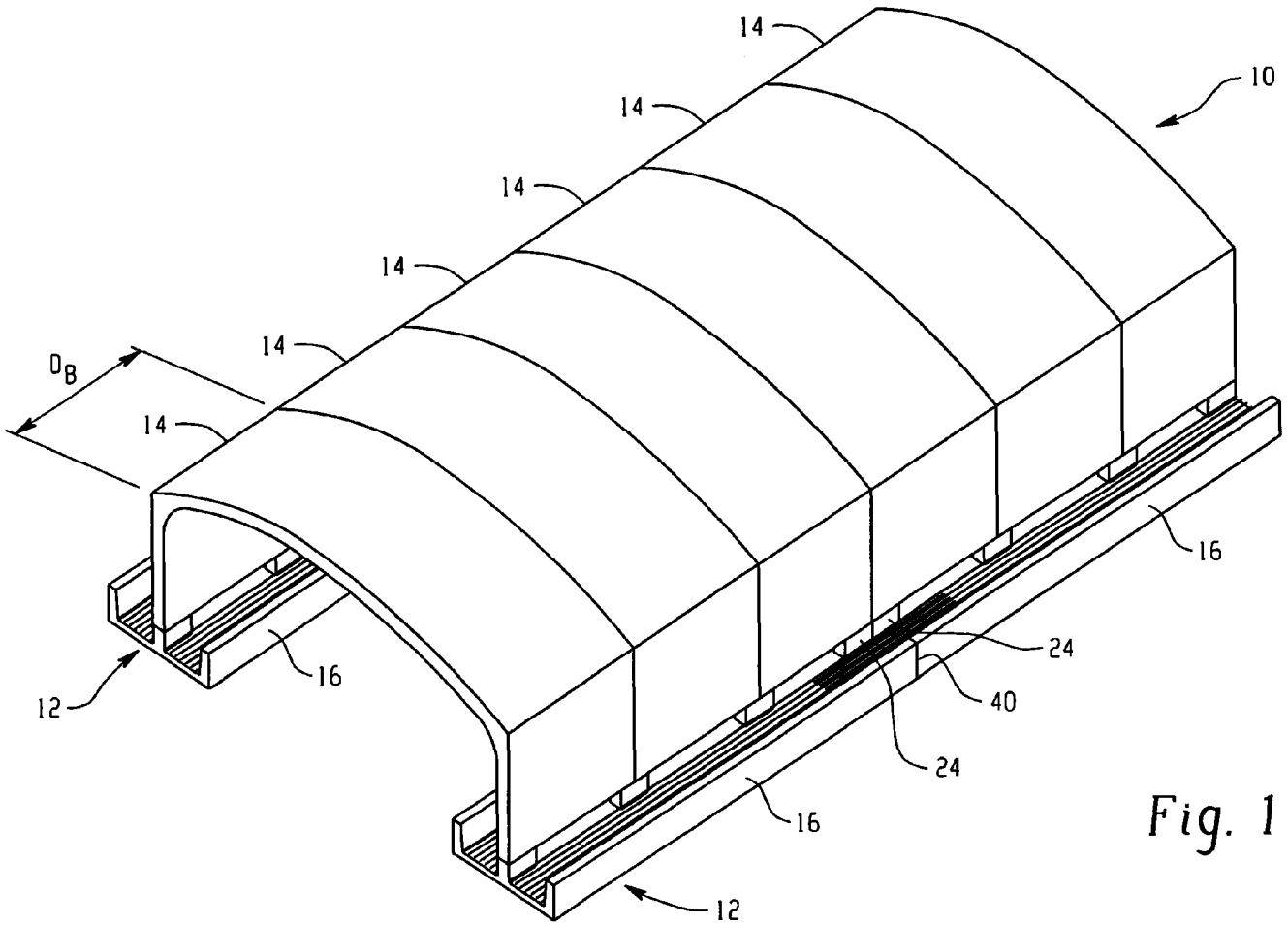
FIG. 1 is a perspective view of a bridge system.

Referring to FIGS. 1-4, a bridge structure 10 is shown atop spaced apart foundation structures 12 that, when completed, are made up of both precast and cast-in-place concrete. In the illustrated embodiment bridge structure 10 is formed by a plurality of side-by-side three sided precast bridge units 14. Each foundation structure 12 is formed by a number of precast concrete foundation units 16 laid end to end (e.g., ends abutting each other). In the illustrated embodiment a length L of each precast foundation unit 16 accommodates three bridge units 14, but many variations are possible. Each foundation unit includes a lower base portion 18 (e.g., as a bottom wall of the unit) with respective upright walls 20 extending upwardly at each side to define a generally U-shaped channel 22. A central region of the channel 22 includes a series of upwardly extending, spaced apart supports 24 upon which the bottom ends of the side walls of the bridge units 14 are supported, either directly or indirectly. In some implementations the bottom ends may sit on the surface of the support, in other implementations the bottom ends may sit on shims or a bracket or other channel member that is mounted on the support. The spacing between the supports 24 may vary, but should be no greater than the depth $D_B$ of the bridge units to be supported thereon. Supports may be located at each end of the foundation unit 16 so that end supports 24 of abutted units 16 will abut with each other as shown, but variations are possible.

Figure 3A:
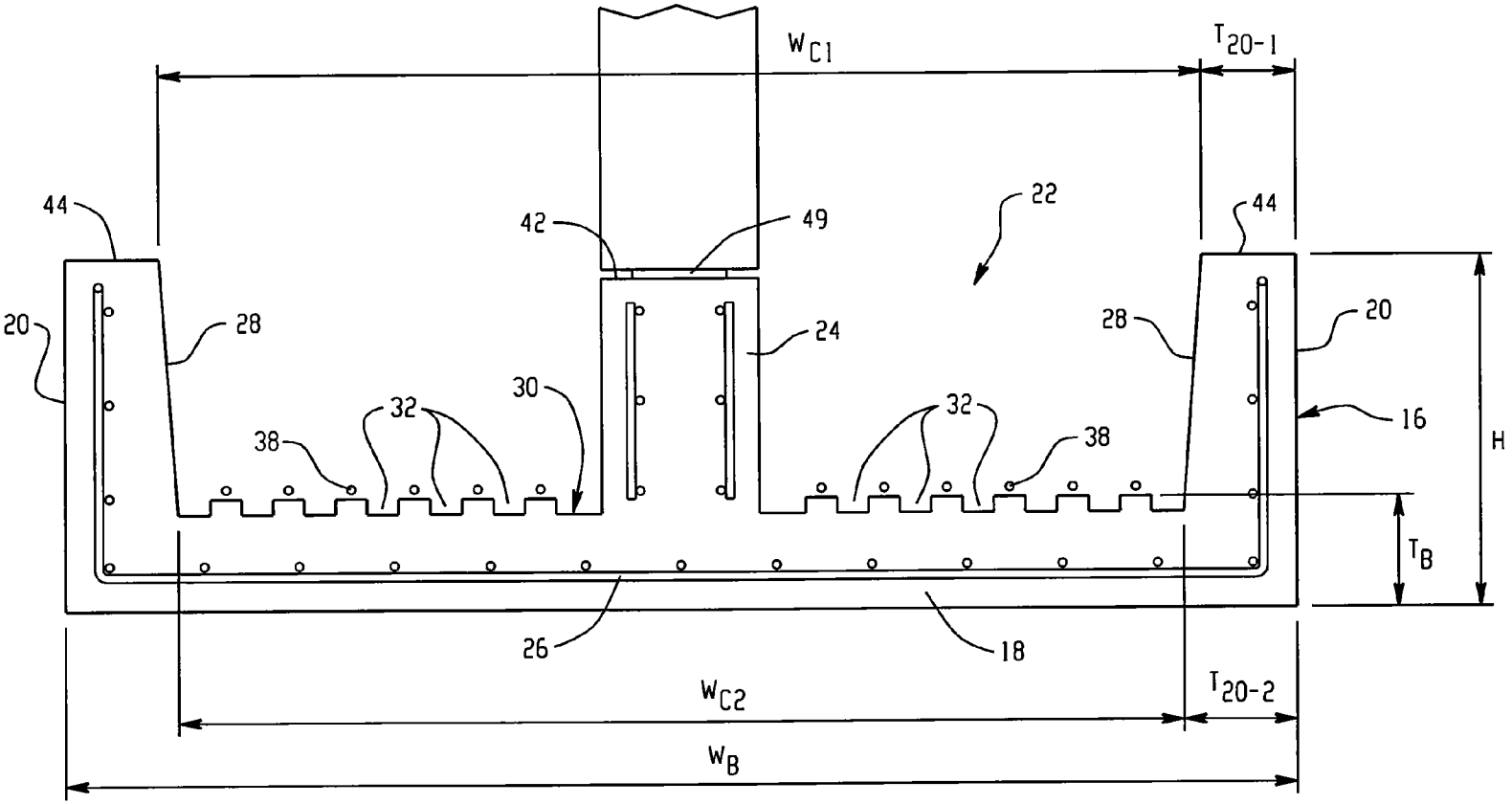
FIGS. 3*a* and 3*b* are end views of embodiments of a foundation unit per FIG. 1.
Figure 3B:
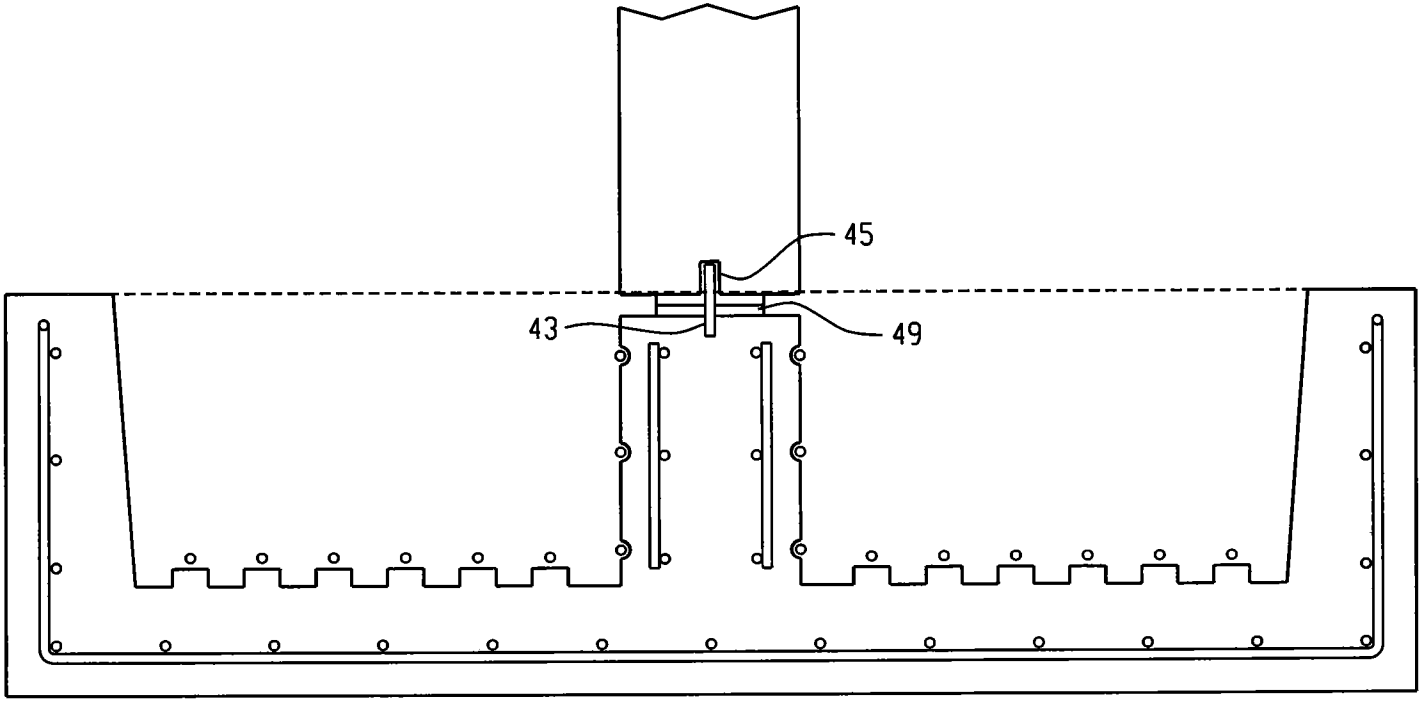
Figure 4:
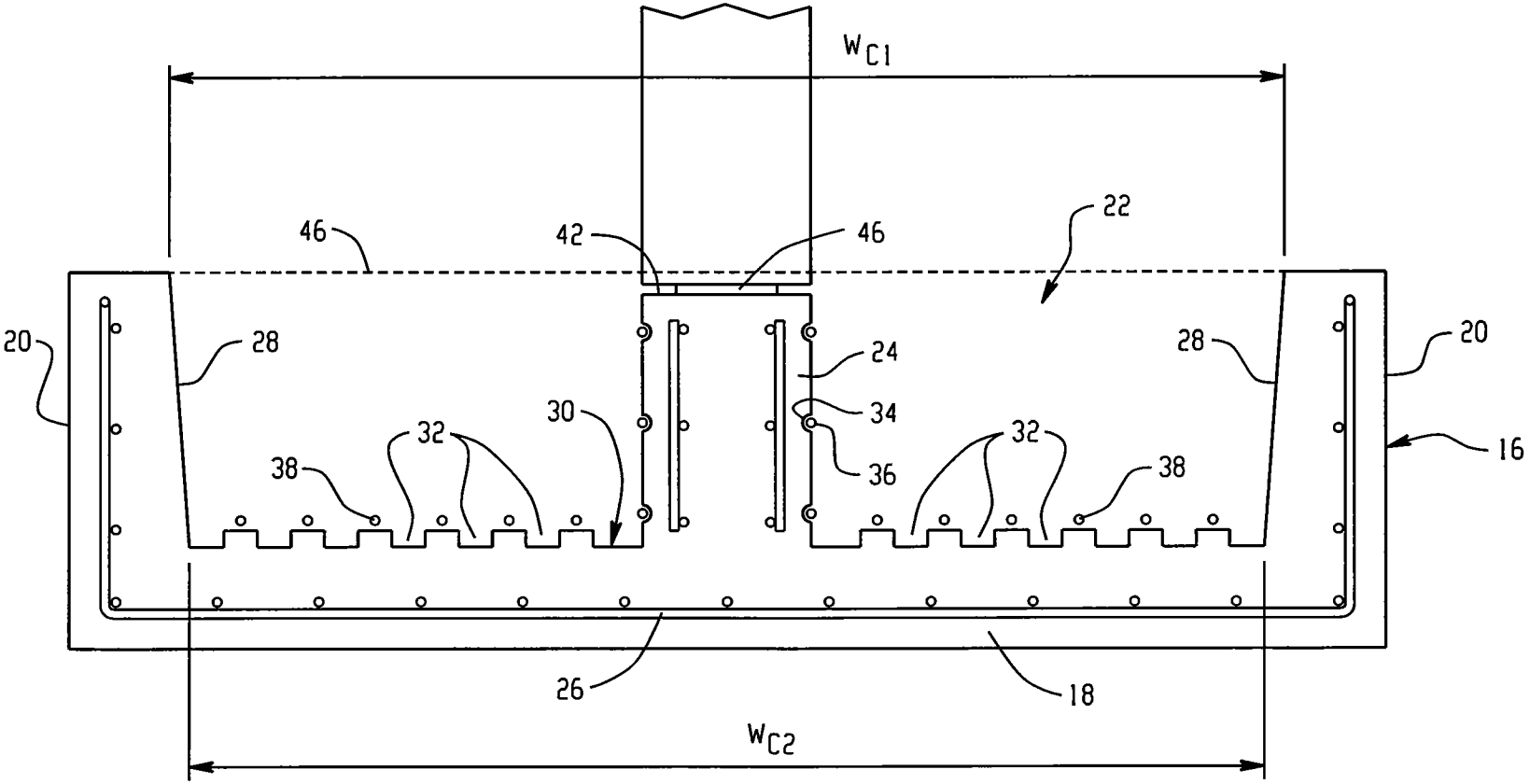
FIG. 4 is an end view of another embodiment of a foundation unit per FIG. 1.

FIGS. 3 and 4 show exemplary end elevation views of alternative embodiments of the foundation units 16. In each illustrated case, the end elevation profile is generally an E-shape with the legs of the E extending upward. It is contemplated that the base 18, walls 20 and supports 24 are formed as a unitary casting with suitable steel reinforcement 26 embedded therein. However, supports 24 could be cast as separate pieces and then attached to the base 18 either after the base 18 and walls 20 have been cast together, or during the casting process for the base 18 and walls 20 (e.g., by placement of the support 24 within the form in which the base 18 and walls are cast). Likewise, one of the base 18 or walls 20 could be cast first and the other of the base or walls then cast in a manner to form the integrated base and wall unit.

The walls 20 of the foundation unit 16 may be formed with inner sides 28 slightly angled (relative to vertical) such that the width $W_{C1}$ of the channel 22 is greater at the top of the unit than the width $W_{C2}$ of the channel 22 at the base 18 of the unit. This configuration provides the advantage of more easily removing the unit from the precast formwork and reducing the weight of the unit. The upper surface 30 of the base 18 may be formed with channels 32 to aid in binding with cast-in-place concrete that will be placed in the channel 22 on-site as will be described in further detail below. Other types of surface features could be provided on the surface 30 to aid in such bonding, including different shapes of channels, different patterns of channels (circular, diagonal, cross-hatch) or even general surface roughening as might be achieved by a rake, any and all of which are referred to herein as "intentional roughening" of the surface. It is also recognized that such intentional roughening could be incorporated into the surfaces 28 of the walls 20 and/or the vertical surfaces of the supports 24.

As shown in FIG. 4, the vertical walls of the supports 24 may be formed (e.g., during the precasting) with horizontally extending pockets 34 configured to receive reinforcement 36 that will be manually placed in the field prior to pouring concrete. A portion of the reinforcement is received in the pocket 34 and a portion of the reinforcement protrudes from the pocket 34. It is contemplated that the reinforcement 36 will extend lengthwise along substantially the full length of the foundation 12 formed by multiple foundation units 16. It is also recognized that these pockets and longitudinal reinforcement could be incorporated into a surface of the end support 24 or one of the side walls 20.

Figure 5:
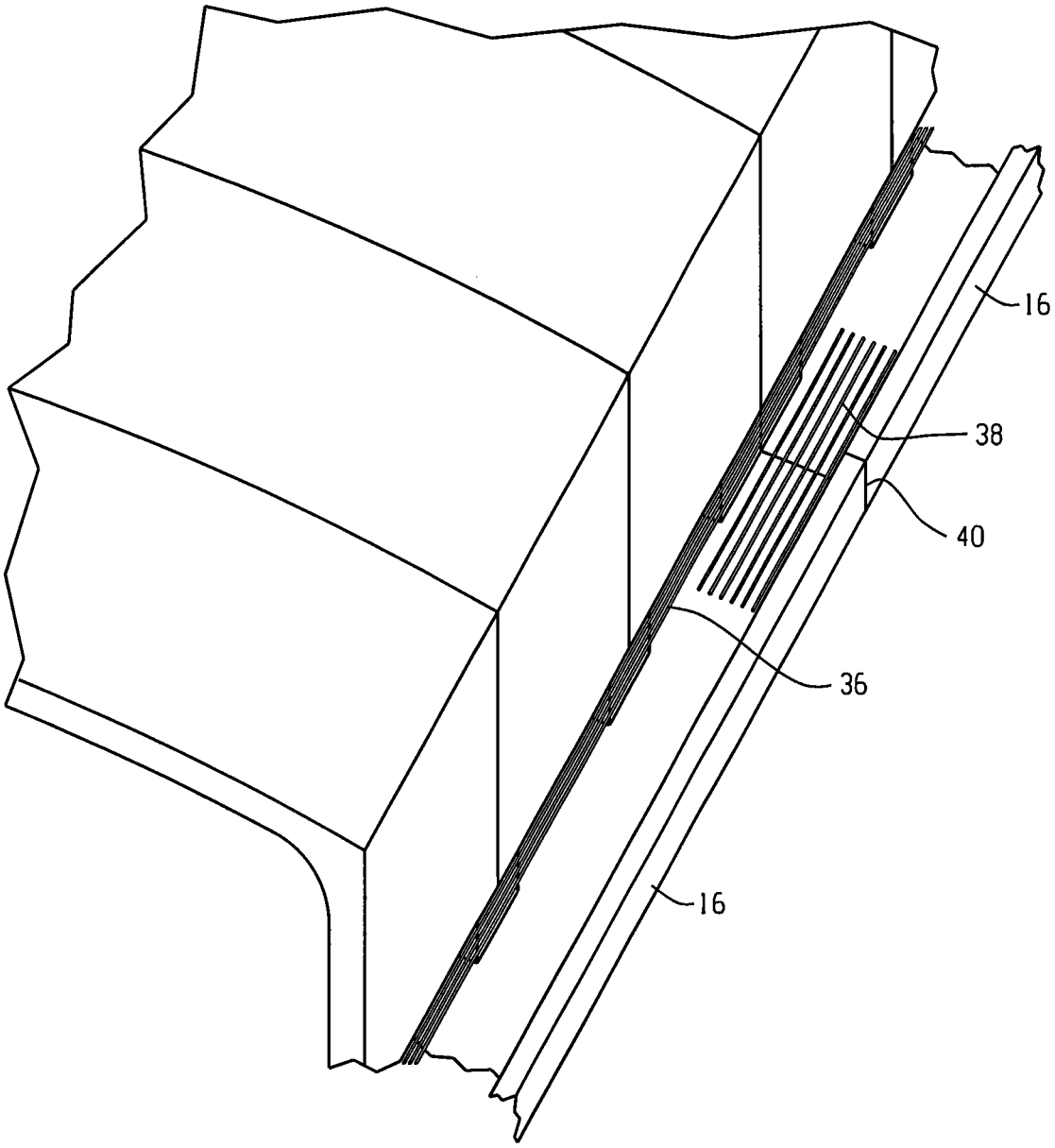
FIG. 5 is an enlarged partial perspective of FIG. 1.

As shown in FIGS. 3 and 4, field placed reinforcement 38 is provided on each side of the support members 24. The reinforcement 38 is used to better tie the ends of adjacent foundation units 16 together with cast-in-place concrete and therefore such reinforcement may be limited to the vicinity of such end to end abutments 40 of the foundation units 16 as suggested in FIG. 5. However, additional field placed reinforcement could be used in some applications.

It is contemplated that the width, length and height of the foundation units 16 may vary depending upon various aspects of the bridge installation. By way of examples, for a bridge installation utilizing bridge units 14 having a span of about 12', a rise of about 6-8' feet and a depth of about 8' the dimensions $T_{20-1}$, $T_{20}$-2, $T_B$, $W_B$ and H (see FIG. 3*a*) could be on the order of about 4", 5", 6", 48" and 24" respectively; for a bridge installation utilizing bridge units 14 having a span of about 24', a rise of about 6-8' feet and a depth of about 8' the dimensions $T_{20-1}$, $T_{20}$-2, $T_B$, $W_B$ and H (see FIG. 3*a*) could be on the order of about 4", 5", 6", 60" and 24" respectively; for a bridge installation utilizing bridge units 14 having a span of about 36', a rise of about 6-8' feet and a depth of about 6' the dimensions $T_{20-1}$, $T_{20}$-2, $T_B$, $W_B$ and H (see FIG. 3*a*) could be on the order of about 4", 5", 7", 96" and 30" respectively; and for a bridge installation utilizing bridge units 14 having a span of about 48', a rise of about 6-8' feet and a depth of about 6' the dimensions $T_{20-1}$, $T_{20}$-2, $T_B$, $W_B$ and H (see FIG. 3*a*) could be on the order of about 4", 5", 8", 144" and 36" respectively. The thickness of the supports 24 may typically be the same as or greater than the thickness of the bottom ends of the bridge unit that will rest thereon. The vertical dimension of supports 24 will adjust based on the overall precast foundation dimension. The horizontal location of support 24 may change within the U-shaped channel, such that in some implementations the supports 24 are centered or substantially centered along the width of the U-shaped channel, while in other implementations the support is offset (either toward the outer side wall of the unit or toward the inner side wall of the unit) partially or entirely from the center of the U-shaped channel.

Figure 2:
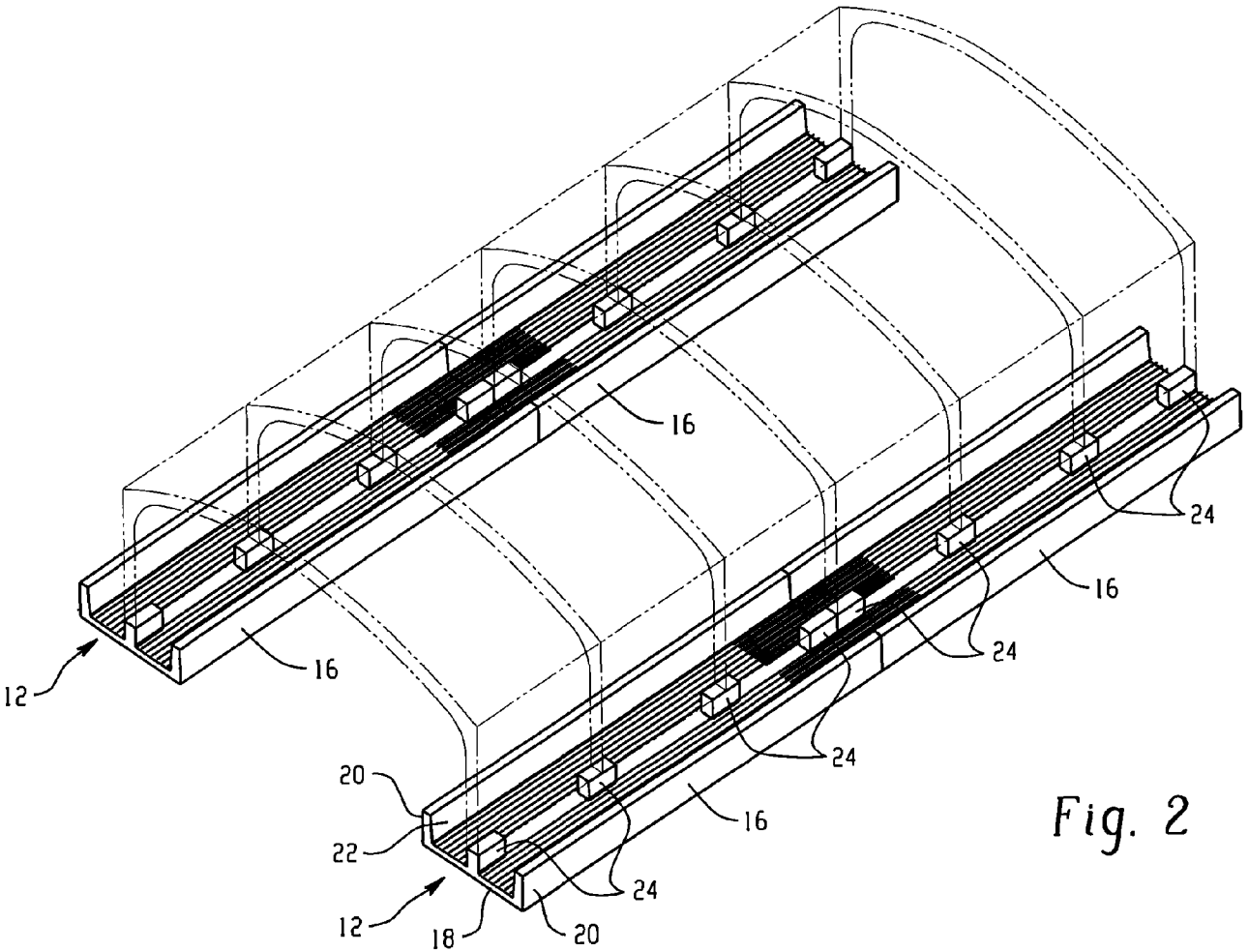
FIG. 2 is a perspective view of FIG. 1 with bridge units shown as transparent.
Figure 6:
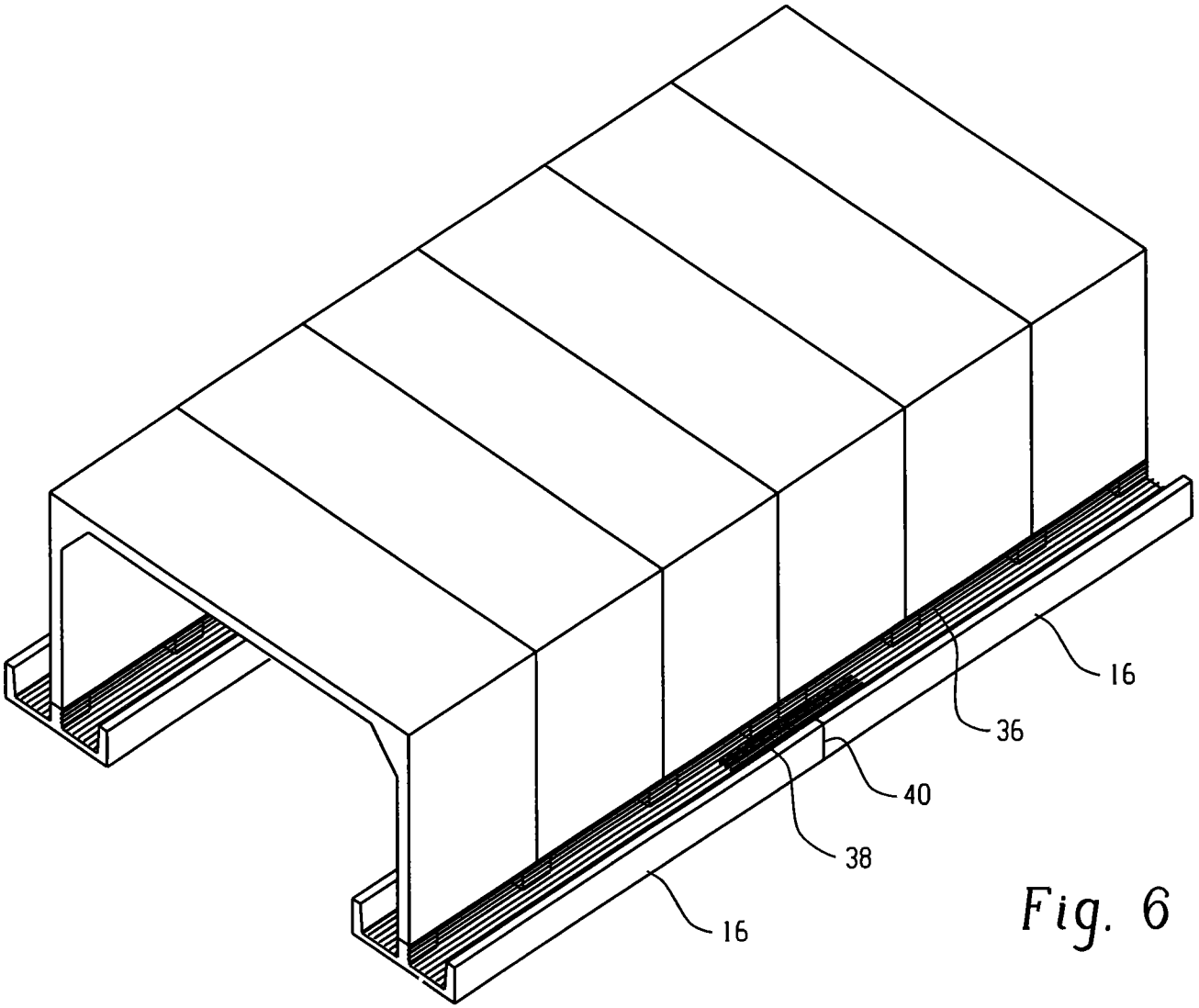
FIGS. 6 and 7 are perspective views of alternative bridge system shapes.
Figure 7:
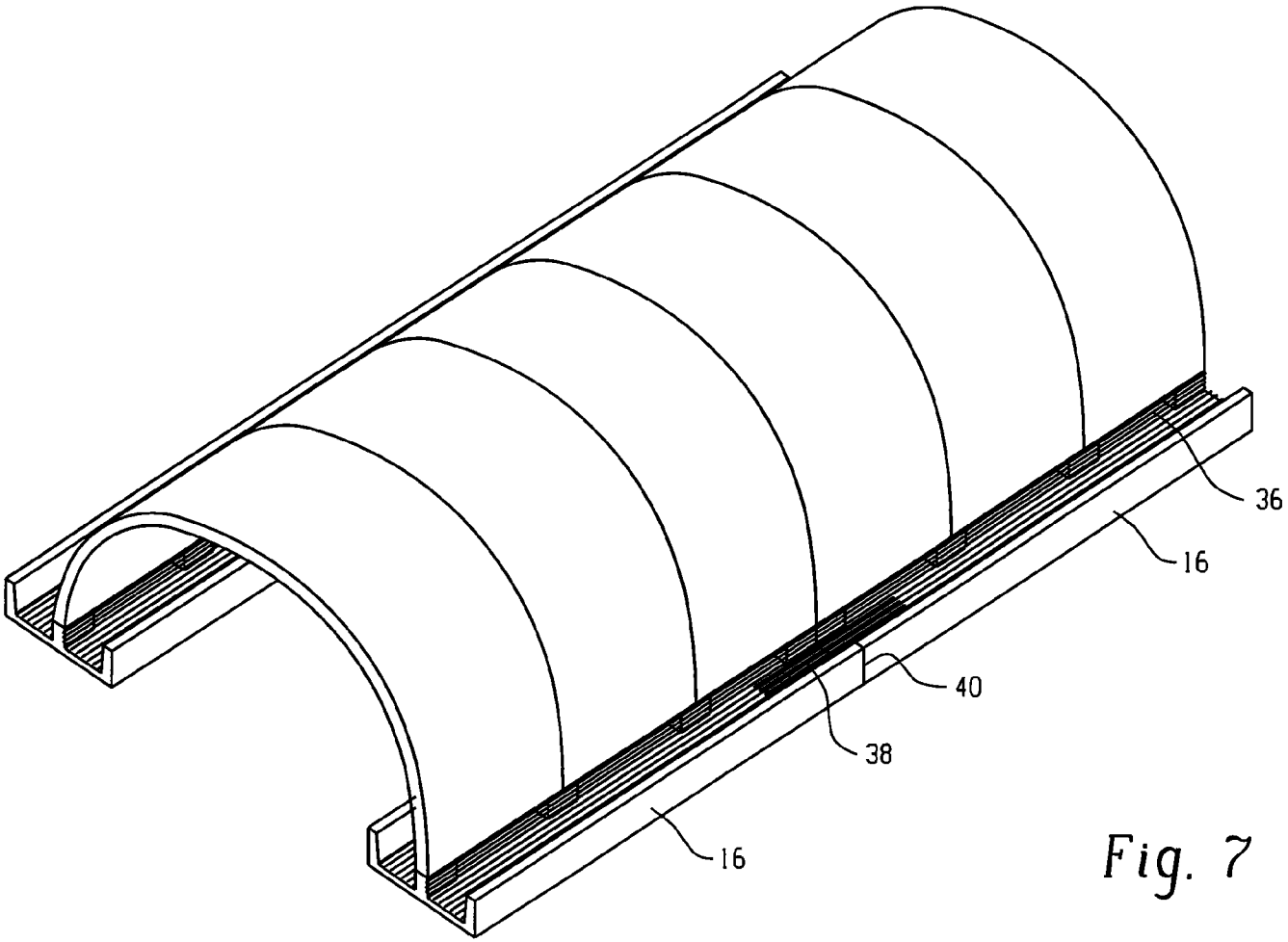

Although FIGS. 1 and 2 contemplate a three-sided bridge structure with straight side walls and a curved top wall, the foundation system of the present application could be used in combination with other bridge unit configurations, including three-sided units with straight side walls and a straight top wall (FIG. 6) or more traditional arch structures in which substantially the entire bridge unit is curved (FIG. 7).

Regardless of the type of bridge unit being installed, the precast foundation units 16 of the present application facilitate the provision of a foundation with advantageous features. The precast foundation units are shipped to and received at a construction site. In use, a final use/installation site is prepared to receive the precast foundation units by excavating to the desired elevation in a smaller area than traditional methods and preparing a level subsurface which may include additional backfill materials on which to install the units.

Once the site is prepared to receive the precast foundation units 16, the units are placed in end to end abutting relationship to form two spaced apart foundation structures 12. In one example, the foundation units 16 are simply placed end to end without any structure holding the units adjacent each other. In another embodiment, alignable bolt pockets may be formed at the end portions of the foundation units (e.g., in side walls 20, base 18 and/or supports 24) and the bolts manually placed prior to setting of the bridge units. In still another embodiment, the bridge units 16 may be formed with lengthwise extending ducts could be formed in the foundation units so that tensioning members can be passed through the full length of the series of foundation units to secured them in abutting relationship. As will be described in further detail below, there may be other precast components to the foundation structure as well (e.g., to support wing walls at the ends of the bridge structure).

Once the precast foundation units 16 are set in desired positions, the reinforcement 36 and 38 can be manually placed and the bridge units placed atop the support structures 24. In this regard, as shown in FIGS. 3 and 4, the upper surface 42 of each support unit 24 may be positioned below the upper surfaces 44 of the side walls 20. The bottom of the bridge unit side walls may rest directly atop the upper surface 42 of the support unit and/or shims 46 may be provided as needed for proper alignment and positioning of the bridge units 14. In certain embodiments, additional tie in and/or alignment structure may be provided between the supports 24 and the bridge units, such as tie rods 43 (FIG. 3*b*) that extend upwardly from the upper surfaces of the supports 24 and into preformed recesses or pockets 45 in the bottom surfaces of the bridge unit side walls, or by forming bolt pockets in both the supports and the bridge unit side walls and installing the bolts once the bridge units are set. The ties rods 43 may be precast into the foundation units 16 or threaded into surface accessible connectors at the end of reinforcement sections that are cast and embedded into the precast foundation unit. Once all bridge units 14 have been set and the reinforcement placed, concrete is poured into the U-shaped channel to complete the foundation structure, thereby forming a composite or combination foundation formed of both precast and cast-in-place concrete. The U-shaped channel may be substantially filled with poured concrete to create a combination precast and cast-in-place foundation structure. The cast-in-place concrete may typically be poured to the top of the channel (as represented by dashed line 46 in FIG. 4) or just below the top of the channel, in either case sufficiently high to embed and capture the bottom ends of each bridge unit so as to integrate the bridge units with the foundation. Preferably, at least about 2 to 3 inches of the bottom ends are embedded in the cast-in-place concrete. It is noted that the cast in place concrete can be applied along the outer portion of the U-shaped channel (i.e., the portion that is external of the bridge units) and the spacing between the supports 24 will allow the concrete to freely flow into and fill the other inner portion of the U-shaped channel as well as the portions aligned and between the supports 24. In this regard, it is also contemplated that in place of a plurality of spaced apart supports 24, an elongated support with one or more transverse bottom openings or channels could be used, such channels providing the route for concrete to flow from the outer portion of the U-shaped channel to the inner portion of the U-shaped channel during the pour. After the cast-in-place concrete has been poured and has cured, the typical backfill and overfill operations including backfilling, compaction and preparation of final surfaces above the structure can take place.

While embedment of the bottom ends of the bridge unit is contemplated, in some instances the concrete may be poured in the U-shaped foundation prior to the spans being set in place. Also, in some embodiments the base 18 of the foundation units may be formed with openings to allow some through passage of concrete which may assist self-leveling.

Figure 8:
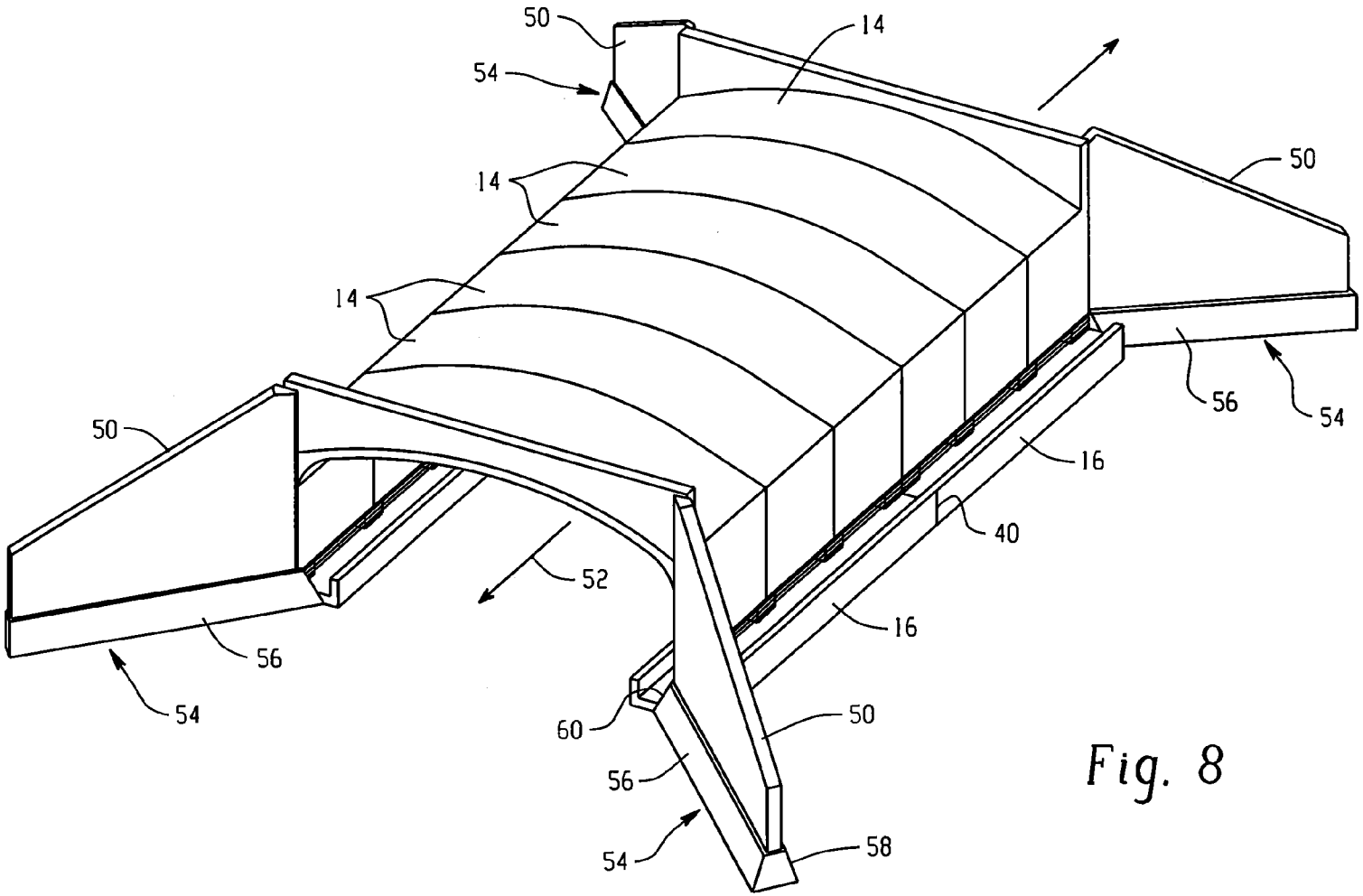
FIG. 8 shows the bridge system of FIG. 1 with wing walls.
Figure 9:
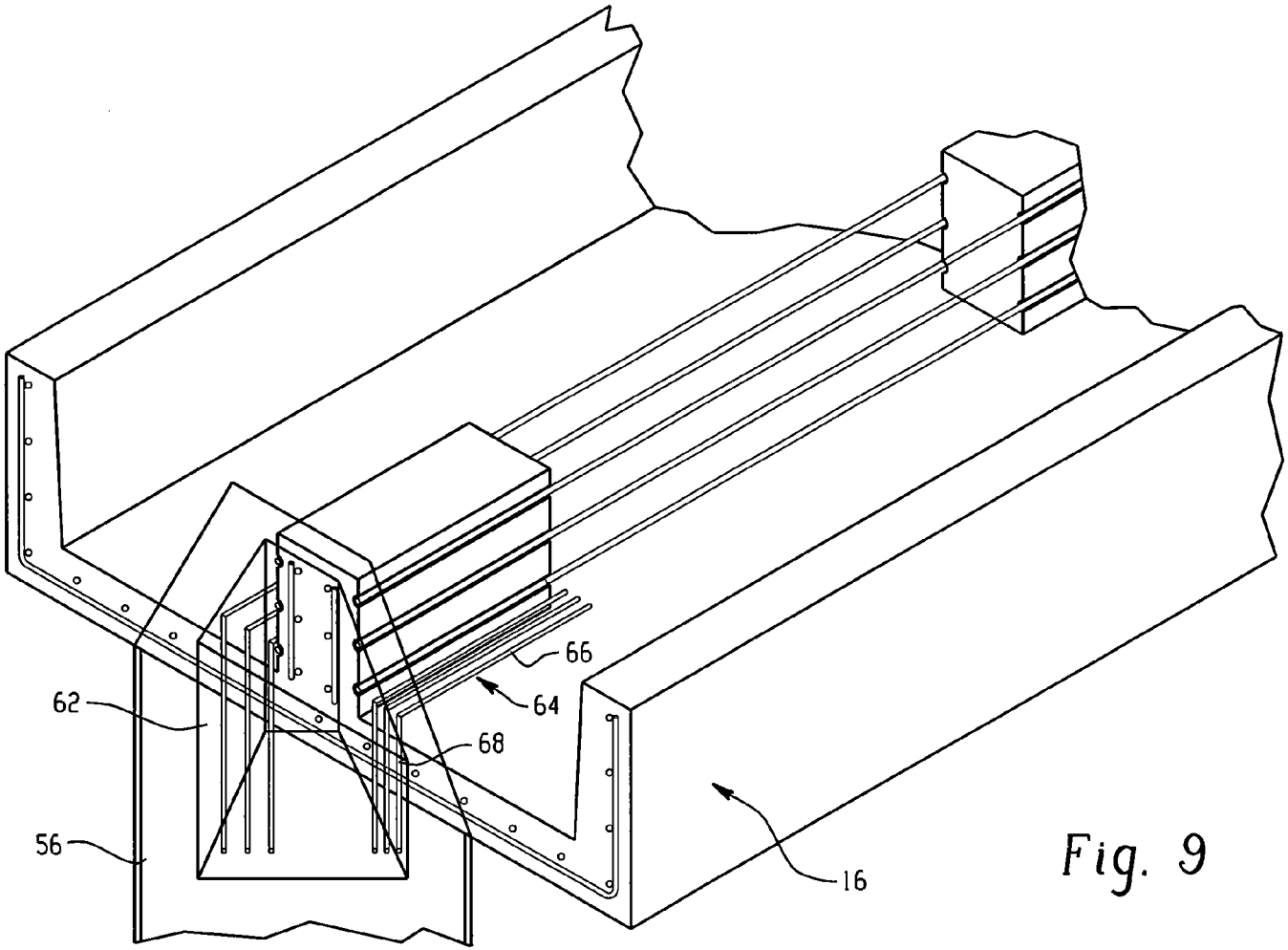
Figure 10:
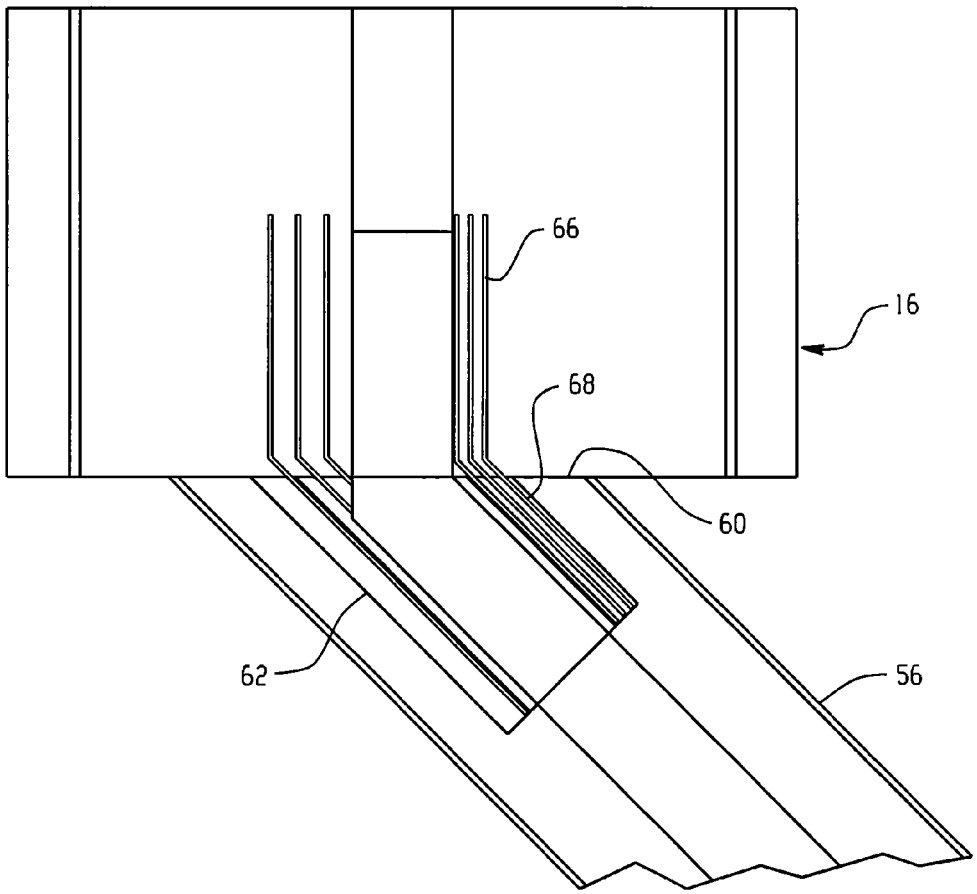

As mentioned above, the foundation system may include additional components. Referring to FIG. 8, a bridge installation may also include wingwalls 50 at each end of the pathway 52 under the bridge units 14. For this purpose, the foundation structures 12 may be formed with wingwall support portions 54 extending angularly away from the pathway 52. Each wingwall support portion 54 is formed by one or more precast concrete wingwall support units 56 that become integrated with the foundation units 16. Referring additionally to FIGS. 9-11, each precast wingwall support or foundation unit 56 may be formed in a trapezoidal shape, or other shape that has a bottom surface that is wider than the top surface. The top surface supports the bottom edge of the wingwall 50 and the bottom surface rests upon the prepared site surface. The trapezoidal shape reduces the volume of concrete needed. One end surface 58 of the unit 56 extends generally perpendicular to a longitudinal axis of the unit 56, while the other end surface 60 extends at an non-right angle (substantially offset from 90 degrees) to the longitudinal axis to define the angle at which the unit 56 will extend away from the foundation unit 16 and pathway 52.

In one embodiment, integration of the units 56 with units 16 is achieved using the cast-in-place concrete. Specifically, the wingwall foundation unit 56, which is precast with necessary reinforcement therein, may include pocket 62 at end 60 and into which reinforcement 64 is positioned prior to the on-site concrete pour. Reinforcement sections 64 include a first leg 66 extending axially along the length of the support unit 16 and a second leg 68 extending axially along the length of wingwall support unit 56 into the pocket 62. As shown, a laterally spaced series of reinforcement bars may be placed at each side of the end support member 24 of the foundation unit 16. When the on-site concrete pour takes place the concrete fills the pocket 62, surrounding the reinforcement. Upon concrete cure, the wingwall support portion 54 becomes an integrated part of the foundation structure 12.

In an alternative embodiment, integration of the units 56 with units 16 may be achieved without the pocket by integrating dowel bars or reinforcing bars into the end 60 of unit 56 during precasting such that either the dowel bars or reinforcing bars extend from the end of the unit or a connector (e.g., internally threaded) is presented at the end face of the unit 56 to which the threaded end of a reinforcement bar can be connected. These dowel bars may be pre-bent or subsequently bent, or the reinforcement subsequently connected to the connectors at the end face, to provide extending reinforcement portions in general alignment with the lengthwise axis of the precast foundation unit 16 as shown. The protruding ends of the dowel rods or reinforcement become embedded in the cast-in-place concrete of the U-shaped channel during the on-site pour. In other embodiments, the dowel rods or reinforcement could pass through openings in the elongated side walls of the precast unit 16 in order to enter the channel.

Figure 20:
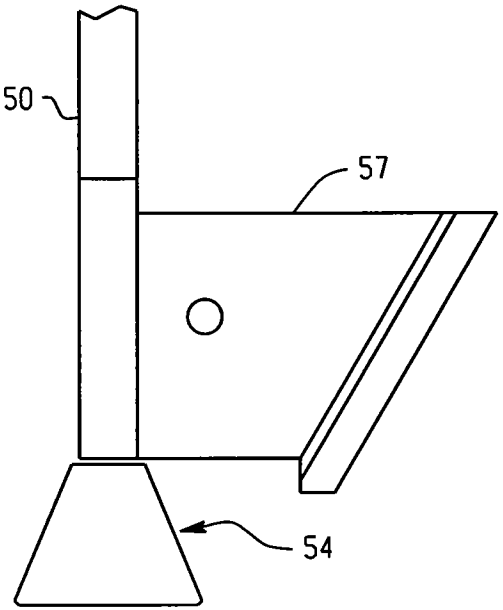
FIGS. 19 and 20 show wing wall anchors.
Figure 19:
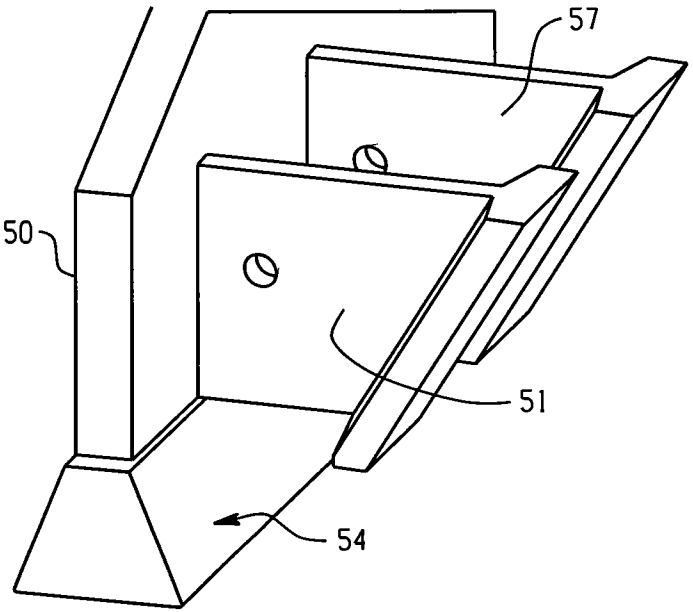

As shown in FIGS. 19 and 20, the wing walls 50 may include anchor members 51 that will become embedded within the surrounding earthen fill material to laterally support the walls.

Figure 13:
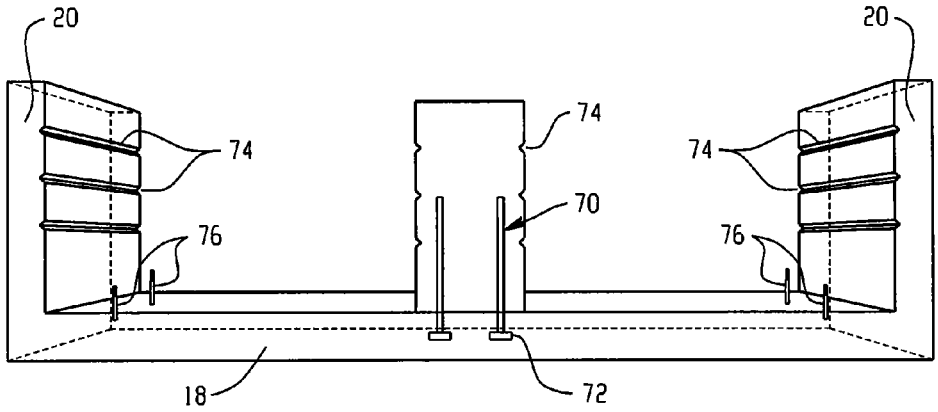

As previously mentioned, the supports 24 could be cast as separate pieces and then attached to the base 18 of units 16 either after the base 18 and walls 20 have been cast together, or during the casting process for the base 18 and walls 20. Referring now to FIGS. 12-13, in one embodiment the supports 24 are precast separate from base 18 and side walls 20. The supports 24 are precast first with partially embedded tie bolts 70 (or button bars) having heads 72 extending therefrom. The supports are then hung into the form that creates the base 18 and walls 20, such that during casting the bolt heads 72 become embedded in the base 18 to secure the supports 24 to the base. The vertical surfaces of the U-shaped channel may also be formed with V-shaped channels to aid in integration with the cast-in-place concrete that will be poured into the U-shaped channel. Transport cables 76 may also be embedded in the base 18 for lifting and placing the precast concrete foundation units 16.

Figure 14:
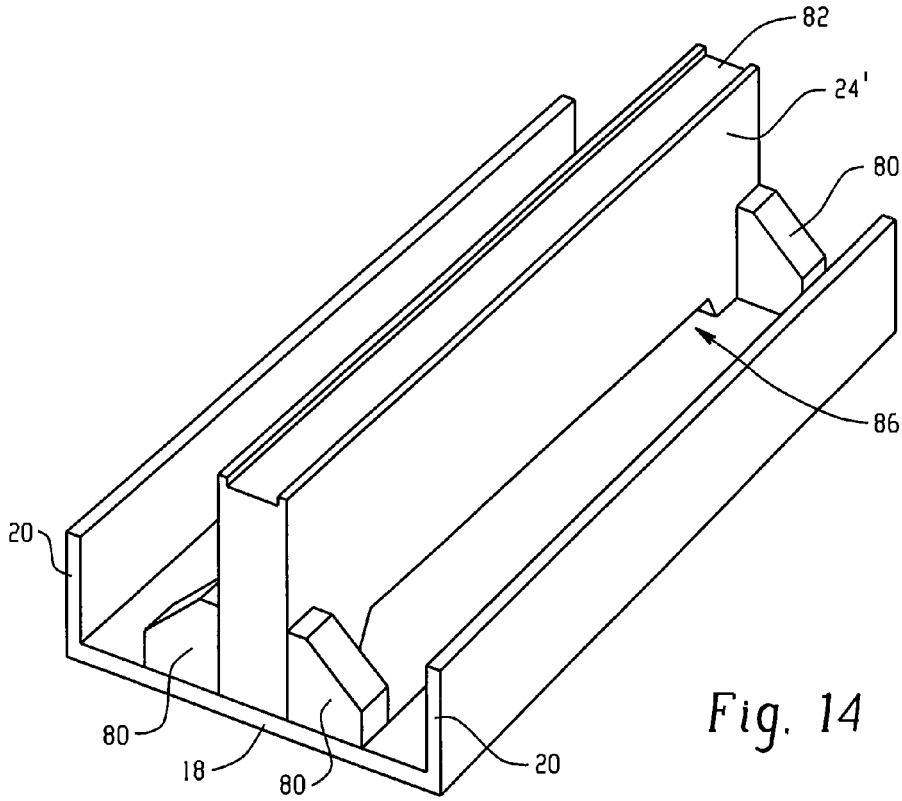
FIGS. 14-18 show aspects of an embodiment in which the foundation structure includes a pedestal.
Figure 15:
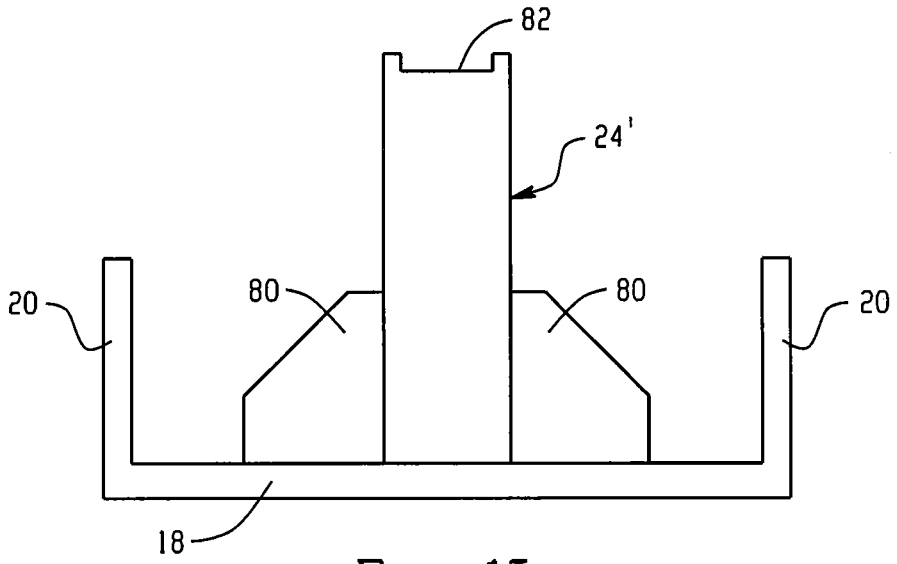
Figure 16:
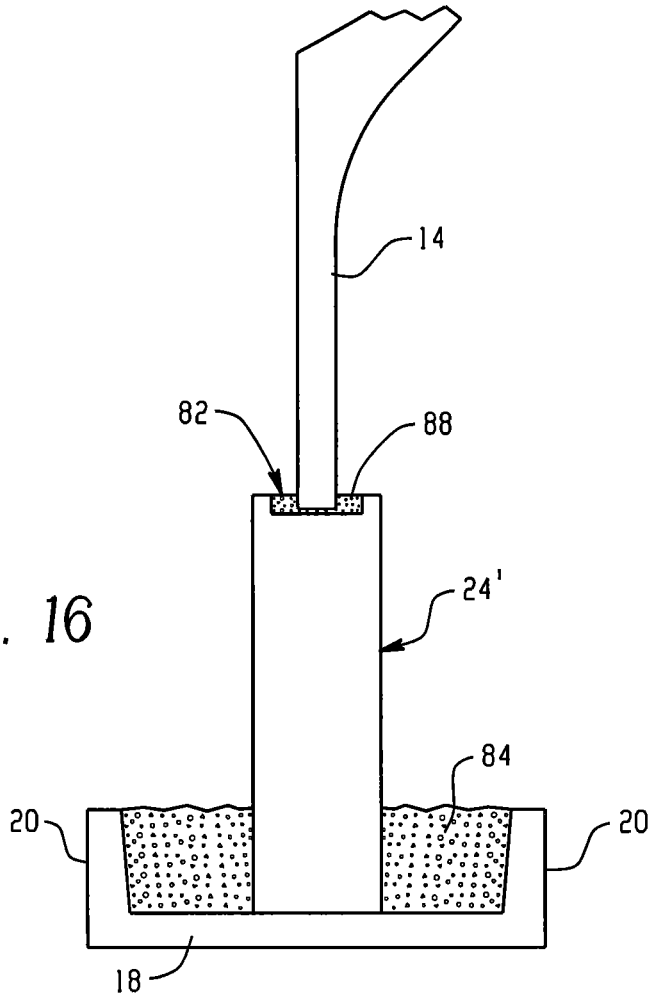

In some embodiments, such as high clearance installations, a pedestal type foundation may be desired. Referring to FIGS. 14-16, a pedestal type implementation is illustrated. In this implementation, the base 18 and side walls 20 are precast as an integrated piece. The pedal structure 24', including end feet 80, is also precast as an integrated piece, with a U-shaped recess 82 in its top surface. The U-shaped member formed by base 18 and side walls 20 and the pedestal 24' are then shipped to the job site as separate precast components. At the job site, the U-shaped member is placed, then the pedestal 24' is positioned within the channel, and an on-site pour of concrete 84 can be used to integrate the two components together. As seen in FIG. 14, the central extent of the pedestal may be formed with a raised, transverse bottom channel 86 to allow poured concrete to flow from one side of the pedestal to the other. After integration, the bridge units can then be placed upon the pedestal 24' with bottom ends within the channel 82, and a concrete grout 88 applied within the channel 82 as well to provide a level of integration between the foundation and the bridge units. In some implementations the pedestal 24' may be centered or substantially centered along the width of the U-shaped channel and in other implementations the pedestal 24' may be offset toward the outer side wall or inner side wall of the precast foundation unit.

Figure 17:
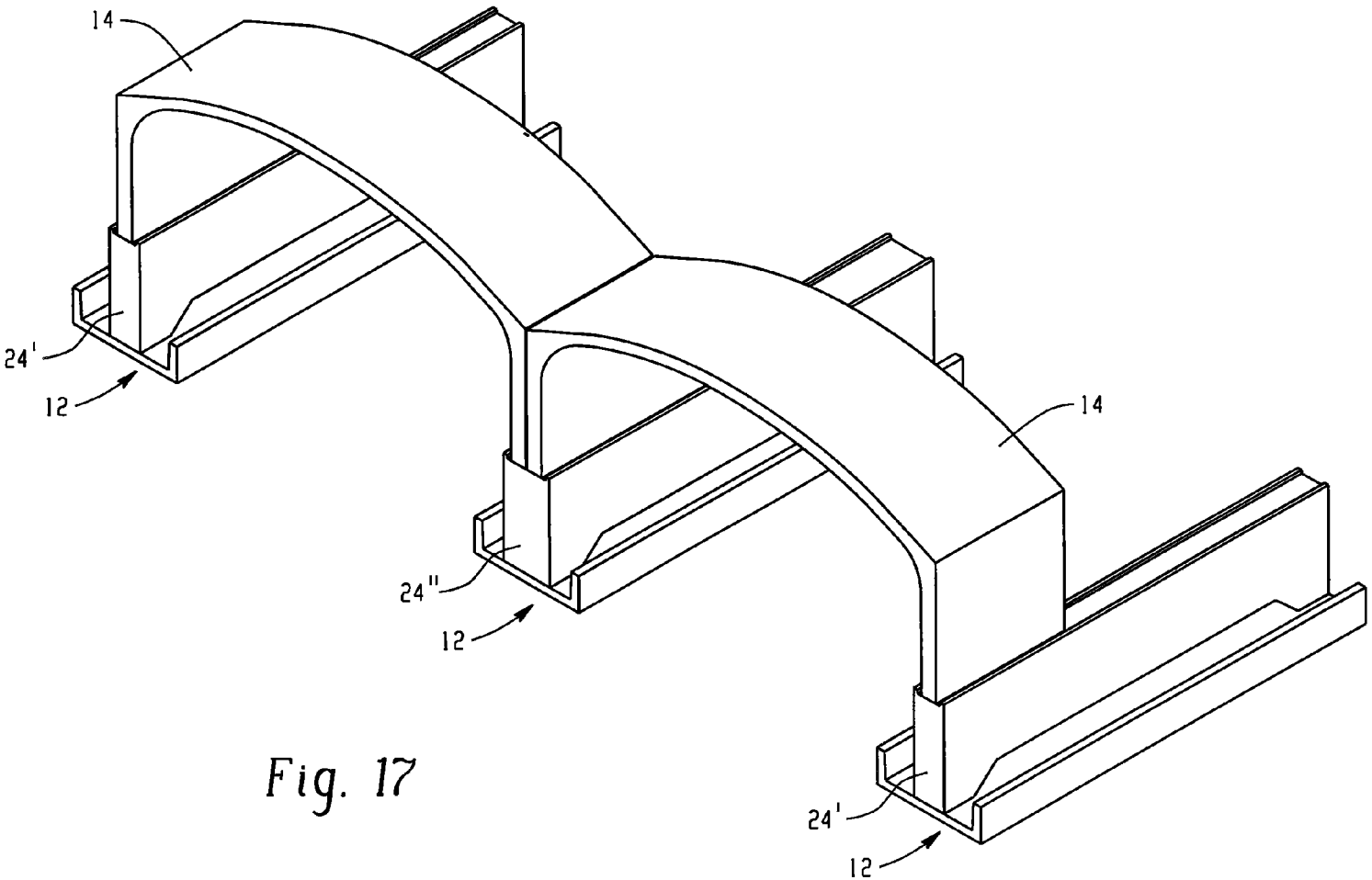
Figure 18:
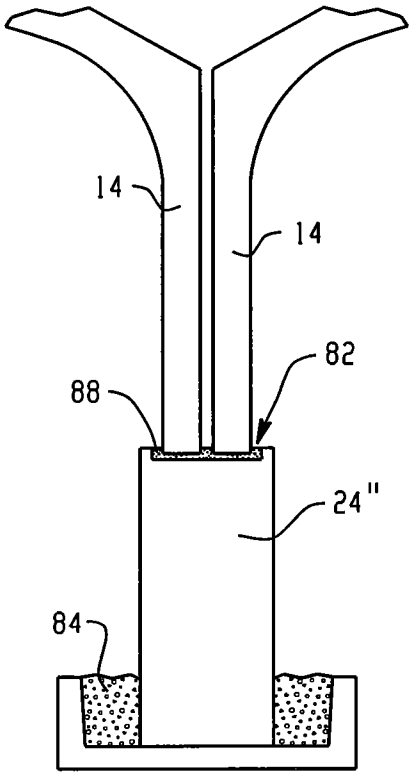

FIGS. 17 and 18 depict a pedestal arrangement used in connection a bridge structure in which two sets of bridge units 14 are utilized in combination with three foundation structures 12 to form two pathways 52. As shown, the pedestal 24" of the center foundation structure 12 is formed wider than the pedestals 24' of the outer foundation structures to provide a wider upper channel 82' capable of supporting the bottom ends of two bridge units 14.

Figure 21:
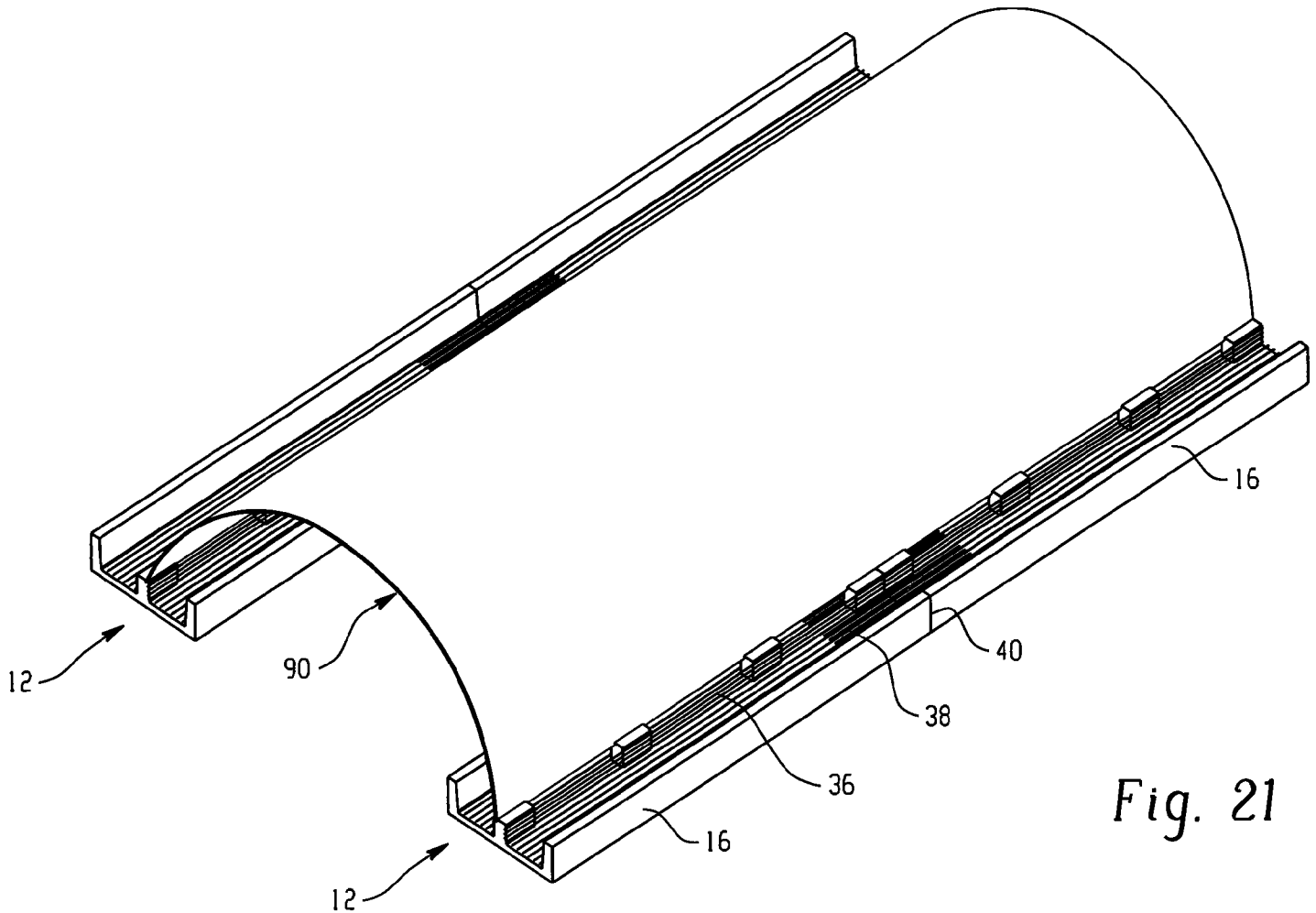
FIGS. 21 and 22 show a bridge system using metal plate.
Figure 22:
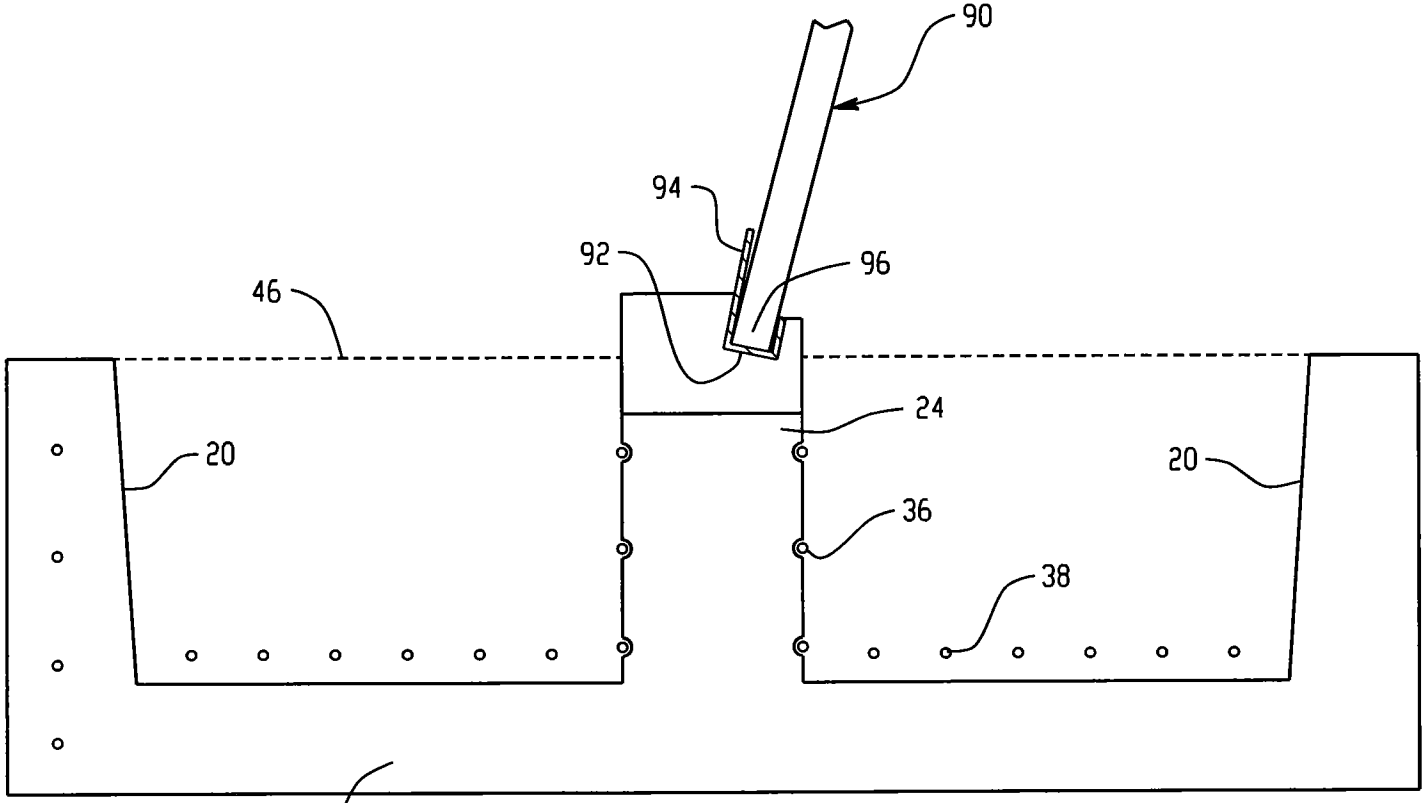

As previously mentioned, the foundation systems described herein can be utilized to support a variety of bridge structures. FIGS. 21 and 22 show an implementation in which the foundation supports a structural metal plate arch structure 90. In this arrangement the center supports 24 are raised above an expected pour level 46 of the cast-in-place concrete and include a channel 92 that receives a u-shaped angle iron 94, both of which are angled/offset from vertical so as to be arranged to receive the bottom end portion 96 of the metal plate arch 90. The angle iron 94 may be embedded in the channel 92 during precast.

Figure 23:
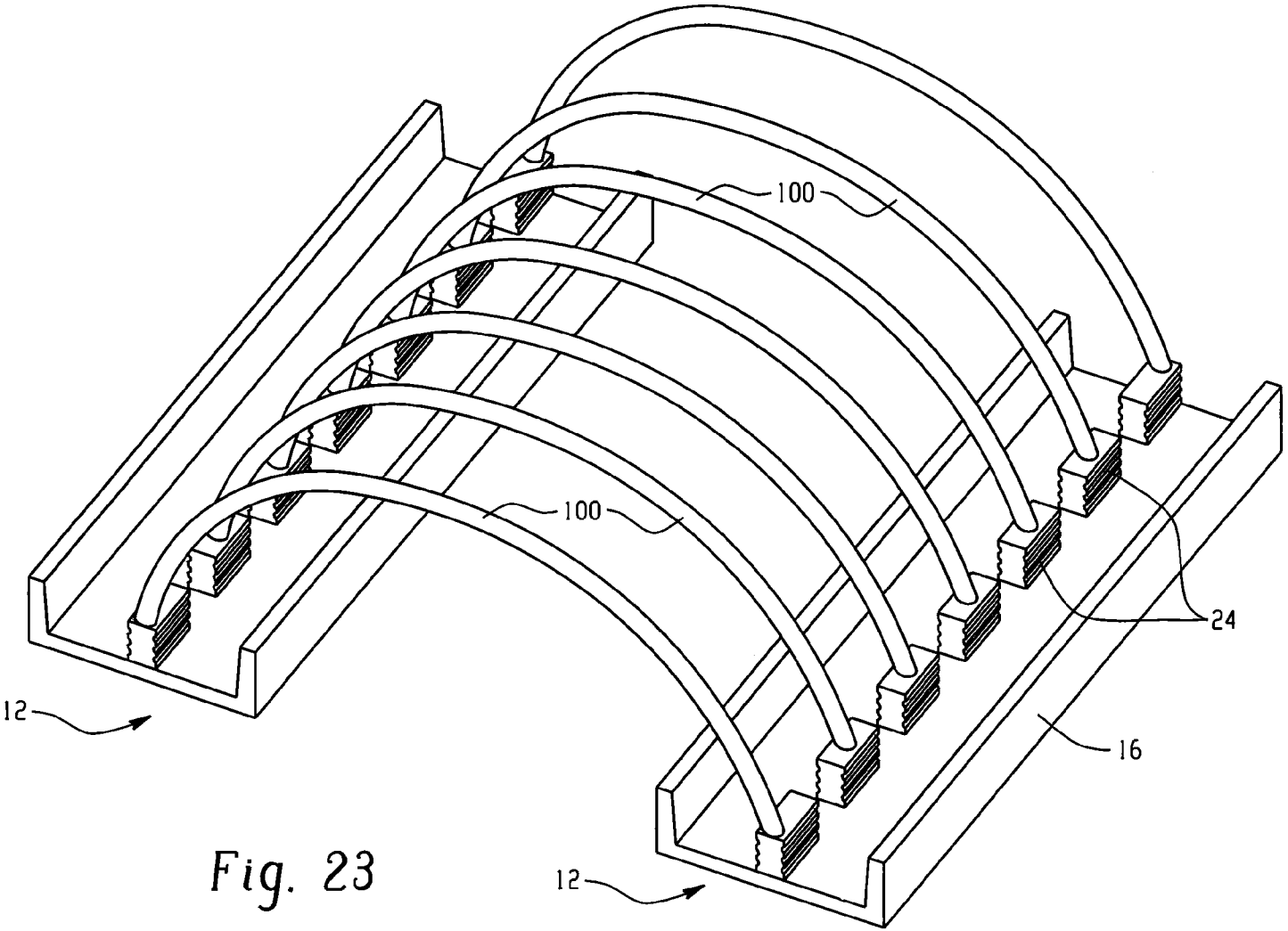
FIG. 23 shows a partial view of a bridge system utilizing a composite bridge structure.

FIG. 23 illustrates an embodiment in which the foundation structures 12 are utilized to support a composite arch. In this arrangement each support 24 receives the lower end of a composite tube 100. Once all tubes are set in place, an on-site concrete pour is performed to embed the lower ends of the tubes in the concrete of the foundation structure. Corrugated decking can then be set over the composite tubes for support thereby, and the composite tubes filled with concrete (e.g., self-consolidating expansive concrete). A concrete layer could also be placed over the corrugated decking.

Figure 24:
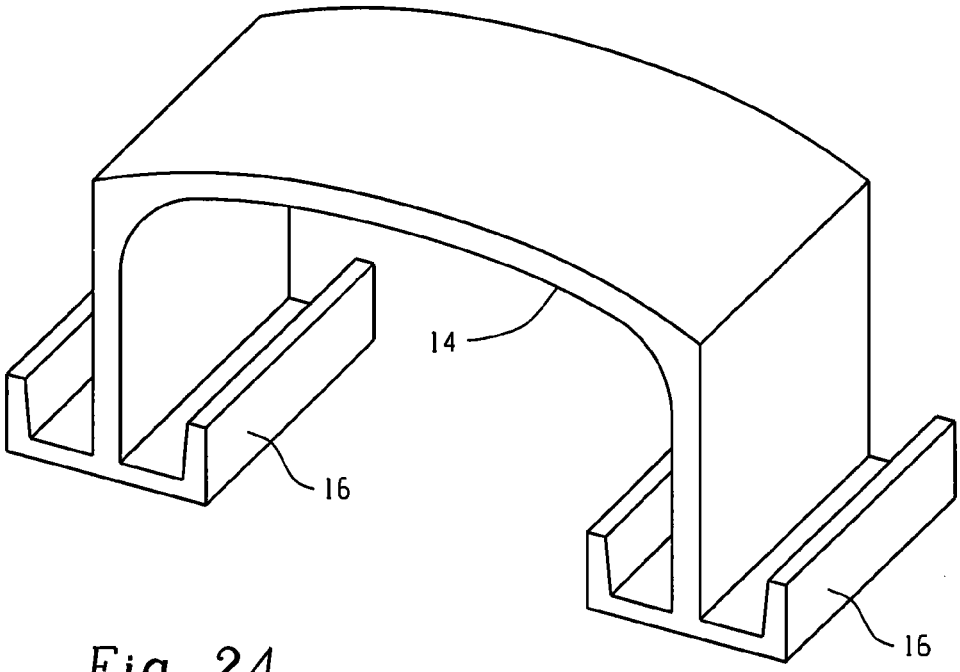
FIGS. 24 and 25 show a foundation structure formed unitary with a bridge unit.
Figure 25:
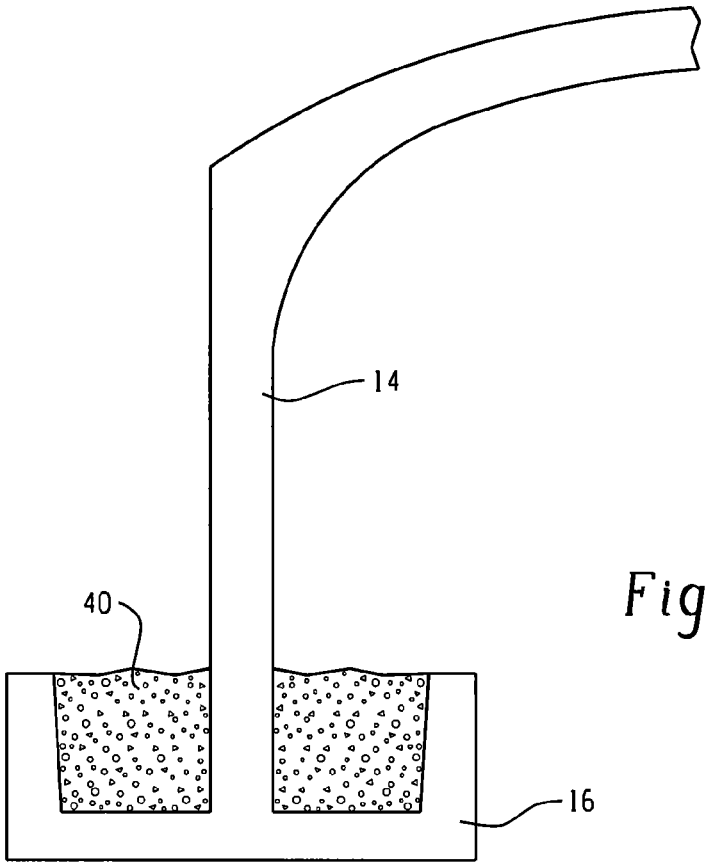
Figure 26:
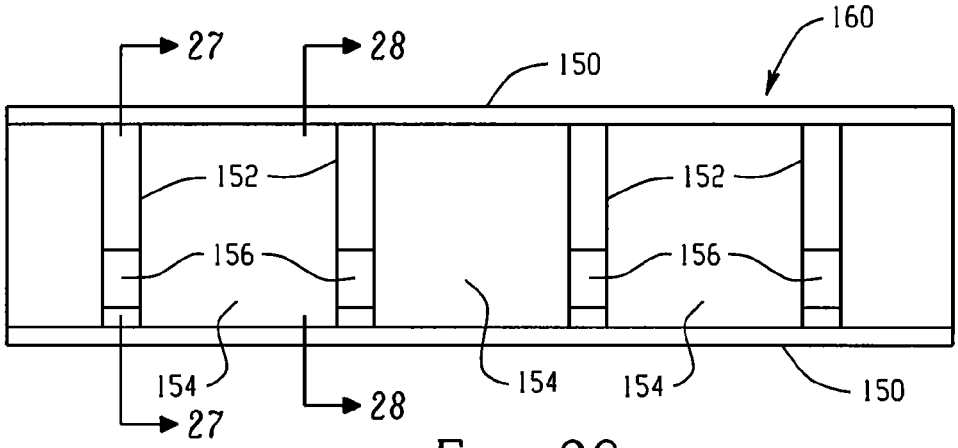
FIGS. 26-31 show another embodiment of a foundation structure.

FIGS. 24 and 25 depict an embodiment in which the foundation units 16 are formed unitary with the bridge unit 14 as a single precast unit. The on-site pour and associated reinforcement complete the foundation structure after the combination units have been placed.

Figure 27:
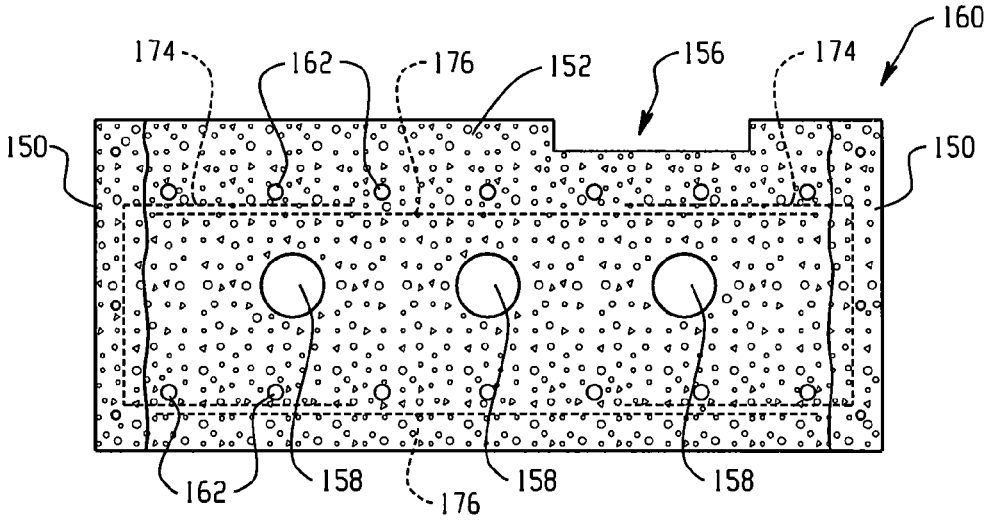
Figure 28:
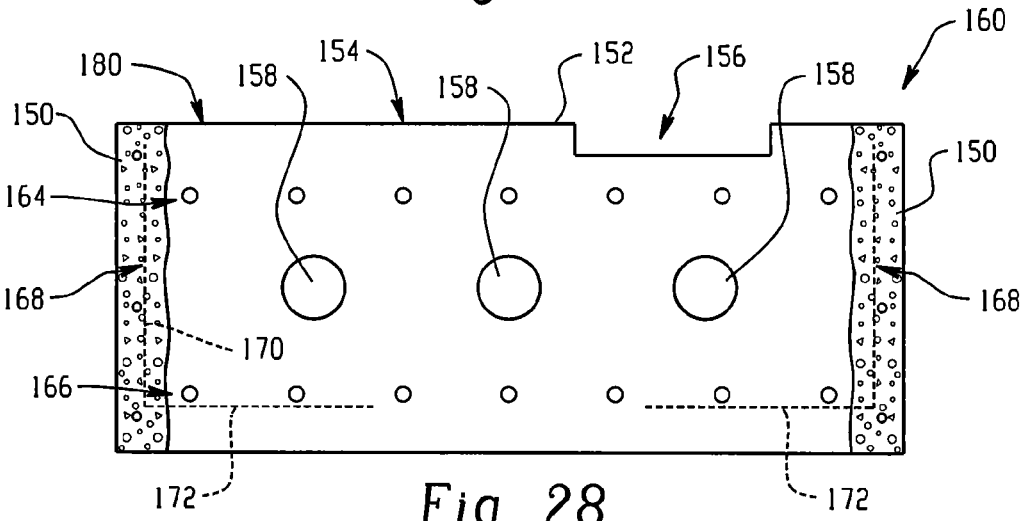
Figure 29:
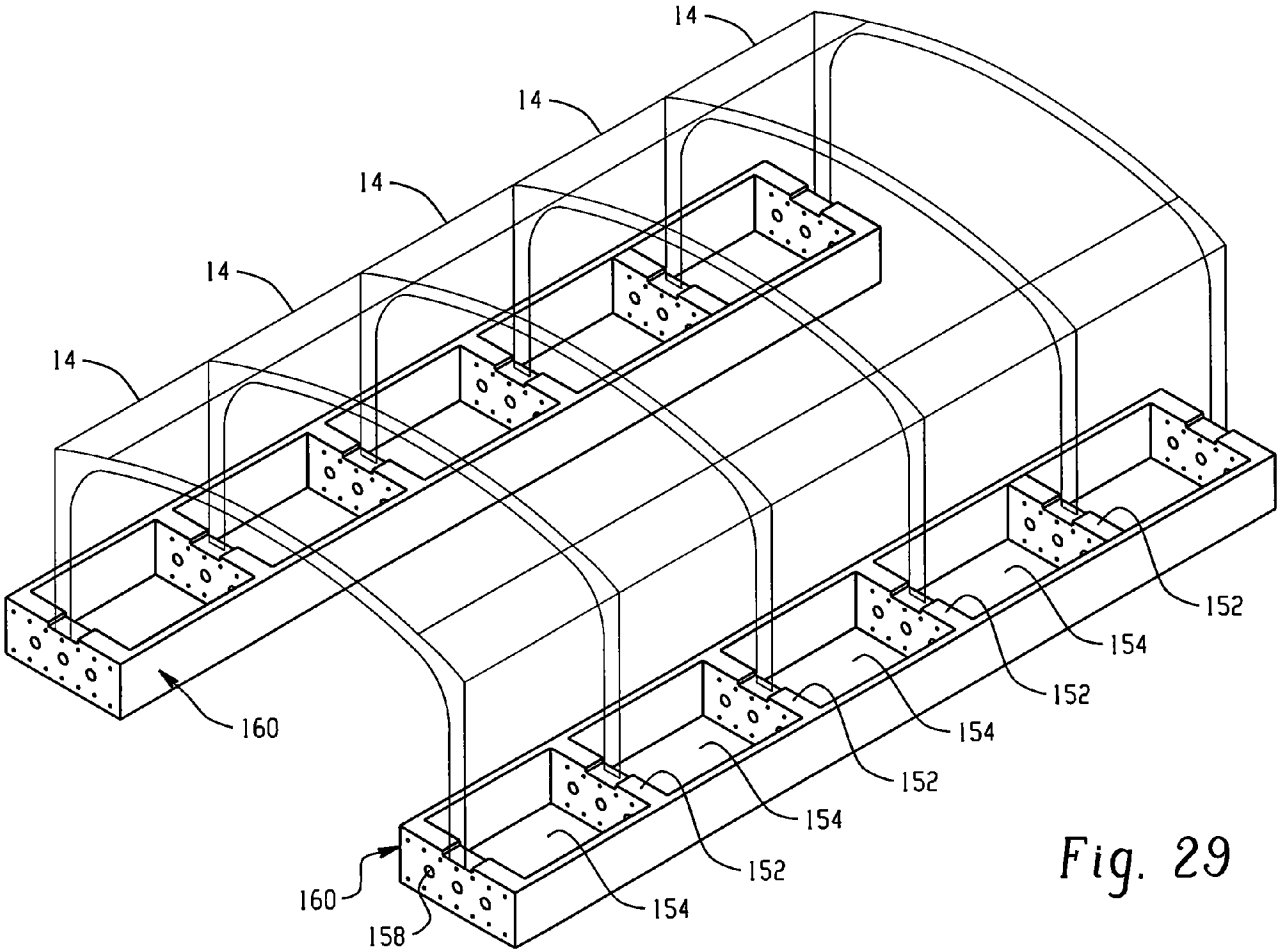

Referring to FIGS. 26-31, in another embodiment the precast foundation units 160 are formed with a ladder configuration in which spaced apart side walls 150 are interconnected by a series of cross-member supports 152. The foundation unit 160 lacks any bottom wall, such that open areas 154 extend vertically from the top to bottom of the units in the locations between the cross-members 152. Each cross-member support 152 includes an upper surface with a recess 156 for receiving the bottom end of the bridge units. The recesses 156 may be centered or offset laterally from a center point along the width of the foundation unit as shown. In some cases the recesses 156 will be positioned toward the inward side of the overall structure, but variations are possible. The spacing of the cross-member supports 152 preferably matches the depth of the bridge units, such that adjacent end faces of the side-by-side bridge units abut each other in the vicinity of the recesses 156 as shown in FIG. 29 where the bridge units 14 are shown in transparent wire form. Each cross-member support 152 also includes one or more larger through openings 158 for the purpose of weight reduction and allowing concrete to flow from one open area or cell 154 to the next. Each cross-member also includes multiple, smaller axially extending reinforcement openings 162. In the illustrated embodiment, an upper row 164 and lower row 166 of horizontally spaced apart openings is shown, but variations are possible. Axially extending reinforcement rods may be extended through such openings prior to delivery of the foundation units 160 to the installation site, but could also be installed on-site if desired. These openings 162 are also used to tie foundation units 160 end to end for longer foundation structures, via reinforcement extending from one unit to the next that becomes embedded in cast-in-place concrete.

As shown in FIG. 28, the side walls 150 include reinforcement sections 168 that include a portion 170 extending vertically and a portion 172 extending laterally into the open cell areas 154 in the lower part of the foundation unit 160. At the installation site, or in some cases prior to deliver to the site, opposing portions 172 of the two side walls can then be tied together by a lateral reinforcement section.

The subject foundation units 160 can, in one embodiment, be manufactured using a single pour technique to produce both side walls and cross-members. In another embodiment, each side wall portion 150 with reinforcement 168 may be formed as separate pieces from respective pours. Once cured, the side wall portions are then arranged with the desired lateral spacing, and suitable formwork added between the side walls (and at the ends of the side walls) to produce the cross-member supports 152 from another pour. In this regard, the reinforcement portions 172 also extend into and within the cross-members to tie the cross-members to the side walls. Moreover, as shown in FIG. 27, upper lateral reinforcement portions 174 can also be provided in the vicinity of the cross-members, as well as lateral reinforcement pieces 176 that tie opposing portions 172 and opposing portions 174 together.

Figure 30:
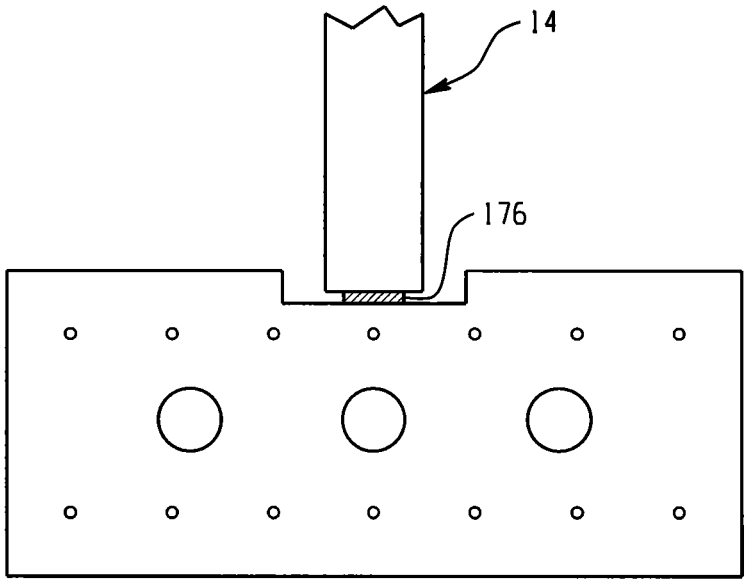
Figure 31:
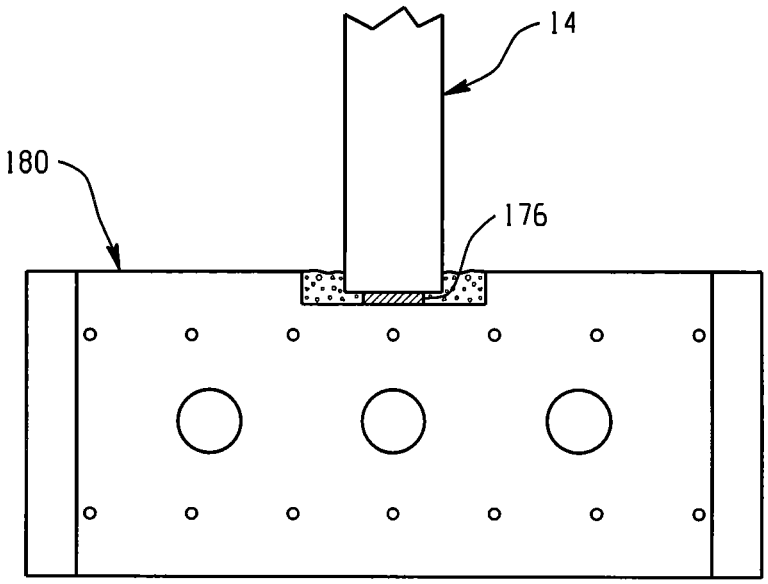

Referring to FIG. 29, the precast foundation units 160 are delivered to the job site and installed on ground that has been prepared to receive the units (e.g., compacted earth or stone). The bridge units 14 are placed after the precast foundation units 160 are set. The cells 154 remain open and unfilled during placement of the bridge units 14 (with the exception of any reinforcement that may have been placed either prior to delivery of the units 160 to the job site or after delivery). As seen in FIGS. 30 and 31, shims may be used for leveling and proper alignment of bridge units 14. Once the bridge units 14 are placed, the cells 154 may then be filled with an on-site concrete pour. The pour will typically be made to the upper surface level 180 of the foundation units 160, resulting in capture and embedment of the bottom portion of the bridge unit side walls within the concrete. In some embodiments, the bottom surface of the bridge unit side walls may be formed with suitable reinforcement extensions or reinforcement openings such that vertical reinforcement can extend from the bottom of the unit.

Figure 32:
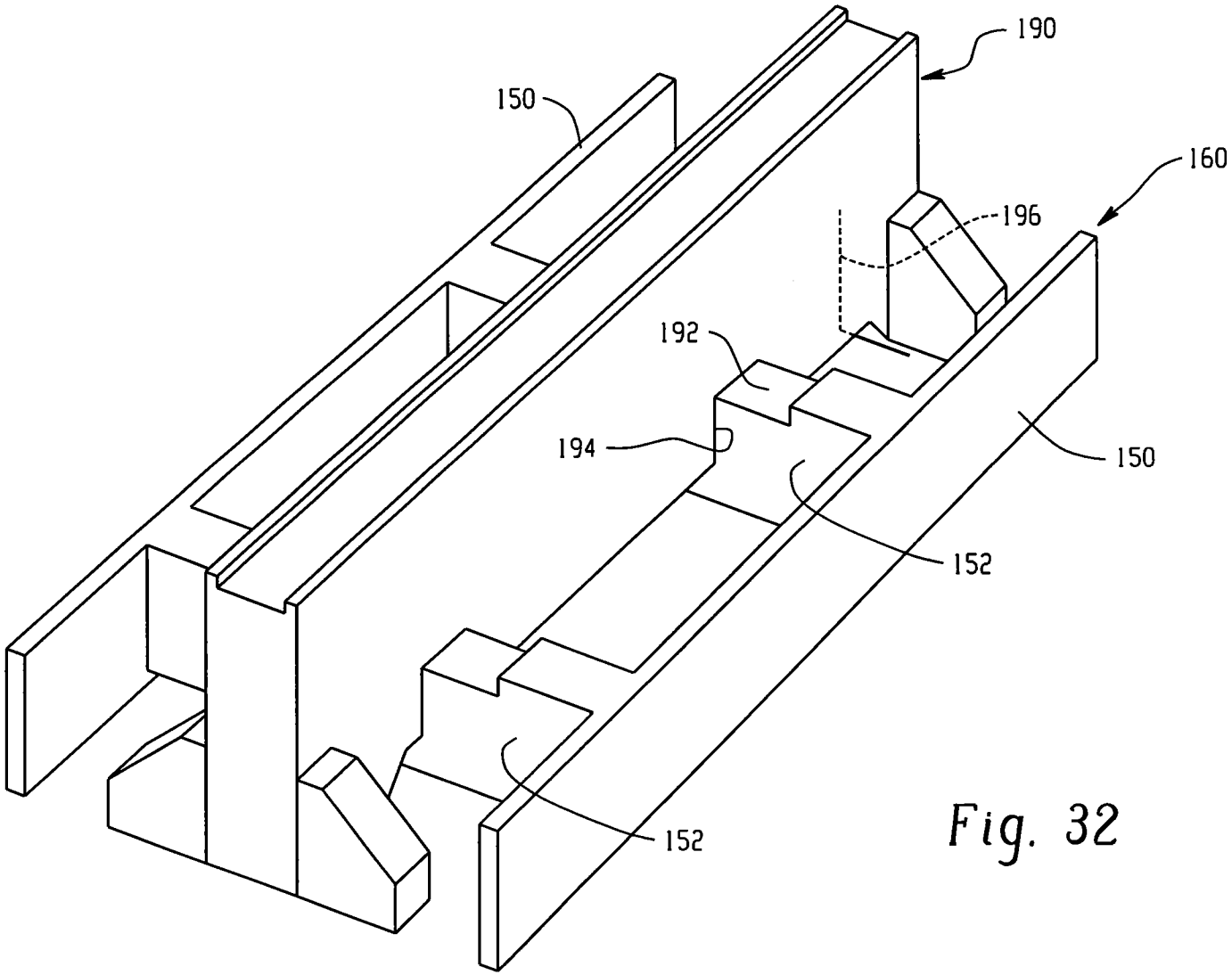
FIG. 32 shows a variation of the foundation structure of FIGS. 26-31 in combination with a pedestal unit.

The foundation unit 160 may also be used in combination with various features and aspects of the other foundation unit embodiments described above, including the wingwall foundation and/or pedestals. For example, as shown in FIG. 32, the precast foundation unit 160 is shown in combination with a precast pedestal unit 190. The two units are formed separately and delivered to a job site. The precast foundation unit 160 is first placed and then the precast pedestal placed within the foundation unit. As shown, the foundation unit cross-members 152 include recesses 192 and the pedestal unit includes upwardly extending cut-outs or slots 194 that fit over the cross-members in the vicinity of the recesses 192. Exemplary reinforcement 196 of the pedestal having both an embedded vertical portion and a protruding lateral portion is shown, it being understood that the reinforcement(s) would extend or be distributed along the axial length of the pedestal. After the pedestal is placed within the foundation unit as shown, an on-site concrete pour is then performed to produce a unitary structure. As with the embodiment of FIG. 14, the central extent of the pedestal unit may be formed with a raised, transverse bottom channel to allow poured concrete to flow from one side of the pedestal to the other. Once cured, the system is ready to receive the bridge units. The pedestal 190 includes an upper recess to receive the bottom of the bridge units.

Figure 33:
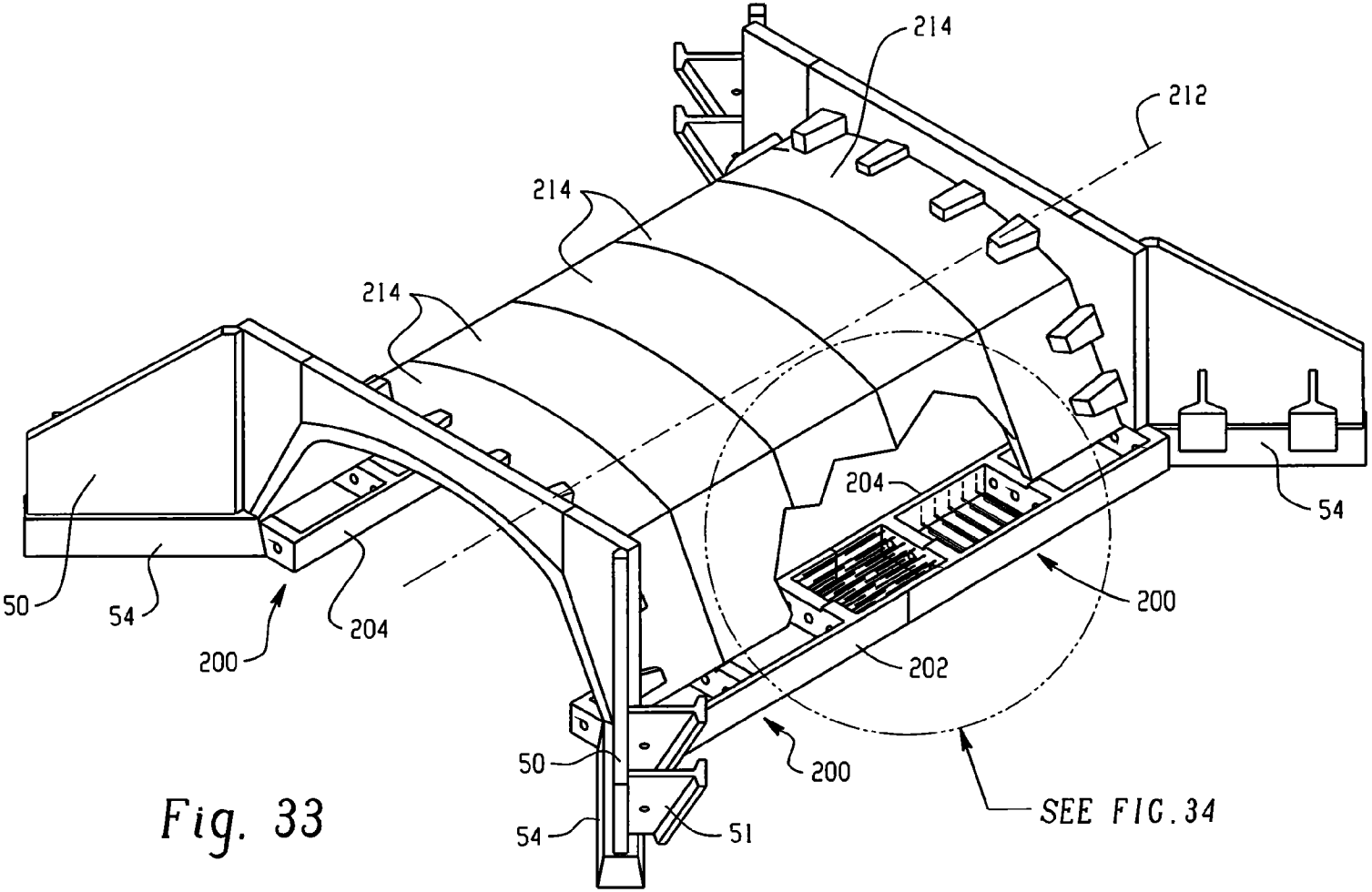
FIGS. 33-35 show another embodiment of a bridge system and associated foundation structure.
Figure 34:
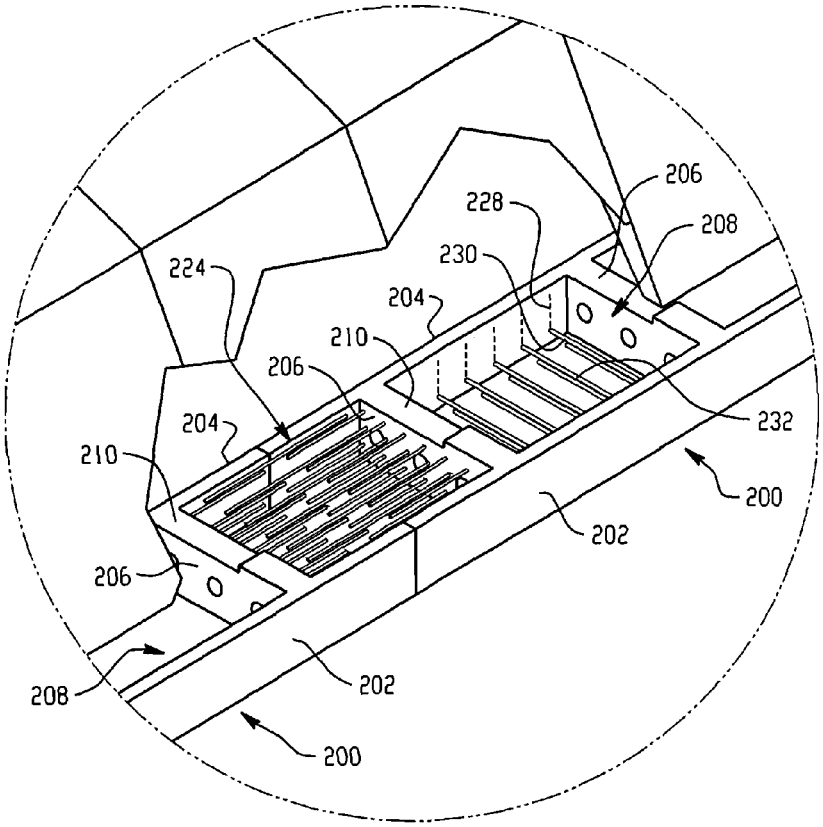
Figure 35:
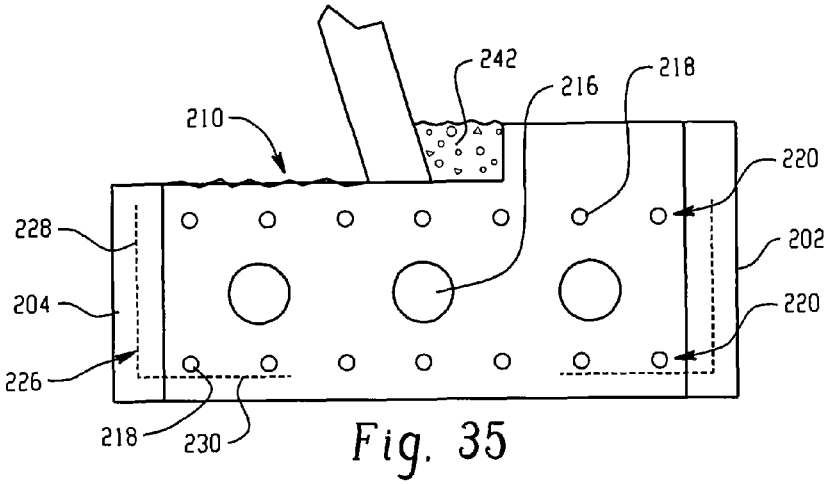

Referring now to FIGS. 33-35, another embodiment having precast foundation units 200 with a ladder configuration is shown. The units have spaced apart and elongated upright walls 202 and 204 forming a channel 205 between the walls and cross-member supports 206 extending transversely across the channel to connect the walls 202 and 204. The foundation units 200 lacks any bottom wall, such that open areas or cells 208 extend vertically from the top to bottom of the units in the locations between the cross-members 206. Each cross-member support 206 includes an upper surface with a recess 210 for receiving the bottom portion of one side of the bridge units 214. In the illustrated embodiment, the side wall portions of the bridge units 214 extend from their respective bottom portions upwardly away from the combination precast and cast-in-place concrete foundation structure and inward toward the other combination precast and cast-in-place concrete foundation structure at the opposite side of the bridge unit. The recesses 210 extends from within the channel 205 toward the inner upright wall member 204, that is the upright wall member positioned closest to central axis 212 of the bridge system. Thus, as best seen in FIG. 33, the upright wall member 202 has a greater height than the upright wall member 204.

The spacing of the cross-members 208 preferably matches the depth of the bridge units 214, such that adjacent end faces of the side-by-side bridge units abut each other in the vicinity of the recesses 210. Each cross-member support 206 also includes one or more larger through openings 216 for the purpose of weight reduction and allowing concrete to flow from one open area or cell 208 to the next. Each cross-member support also includes multiple axially extending reinforcement openings 218. In the illustrated embodiment, an upper row 220 and lower row 222 of horizontally spaced apart openings 218 is shown, but variations are possible. Axially extending reinforcement may be extended through such openings prior to delivery of the foundation units 200 to the installation site, but could also be installed on-site if desired. These openings 218 are also used to tie foundation units 200 end to end for longer foundation structures. In this regard, the ends of the foundation units 200 that are meant to abut an adjacent foundation unit may be substantially open between the upright wall members 202 and 204 such that the abutting ends create a continuous cell 224 in which cast-in-place concrete will be poured. However, the far ends of the end foundation units 200 in a string of abutting units may typically include an end-located cross-member 206 as shown.

The walls 202 and 204 include reinforcement 226 that includes a portion 228 extending vertically and a portion 230 extending laterally into the open cell areas 208 in the lower part of the foundation unit 200. At the installation site, or in some cases prior to delivery to the site, opposing portions 230 of the two side walls can then be tied together by a lateral reinforcement section 232.

The subject foundation units 200 can manufactured in a manner similar to units 160 as described above, with cross-member supports 206 also including reinforcement similar to that of cross-member supports 152.

The precast foundation units 200 are delivered to the job site and installed on ground that has been prepared to receive the units (e.g., compacted earth or stone). The bridge units 214 are placed after the precast foundation units are set. The cells 208 remain open and unfilled during placement of the bridge units 214 (with the exception of any reinforcement that may have been placed either prior to delivery of the units 200 to the job site or after delivery). Shims may be used for leveling and proper alignment of bridge units 214. Once the bridge units 214 are placed, the cells 208 may then be filled with an on-site concrete pour. The pour will typically be made to the upper surface level of the foundation units 200. In this regard, and referring to FIG. 35, due to the difference in height of the respective sides of the foundation unit 200, the bottom portion 240 of the bridge unit will be captured and embedded within the cast-in-place concrete 242 at the outer side of bottom portion 240. After the on-site pour, the cast-in-place concrete at the outer side of the bottom portion 240 of the bridge unit is higher than a bottom surface of the bottom portion 240 to embed the bottom portion at its outer side, and the cast-in-place concrete at the inner side of the bottom portion of the bridge unit is substantially flush with the bottom surface of the bottom portion 240. In this manner, the flow area beneath the bridge units is not adversely impacted by embedment of the bottom portions 240 of the bridge units.

The foundation unit 200 may also be used in combination with various features and aspects of the other foundation unit embodiments described above, including the wingwall foundation and/or pedestals. For example, the precast foundation unit 200 may be used in combination with a pedestal structure. Moreover, the foundation units 160 and 200 are both well adapted for use in connection with pile foundation systems. That is, the support piles can be driven into the ground at the intended use location of the unit (before or after placement of the unit) with the upper ends of the piles protruding into the open cell areas. When the on-site pour is carried out, the piles become embedded in the cast-in-place concrete, structurally tying the combination precast and cast-in-place foundation structure to the piles.

Figure 39:
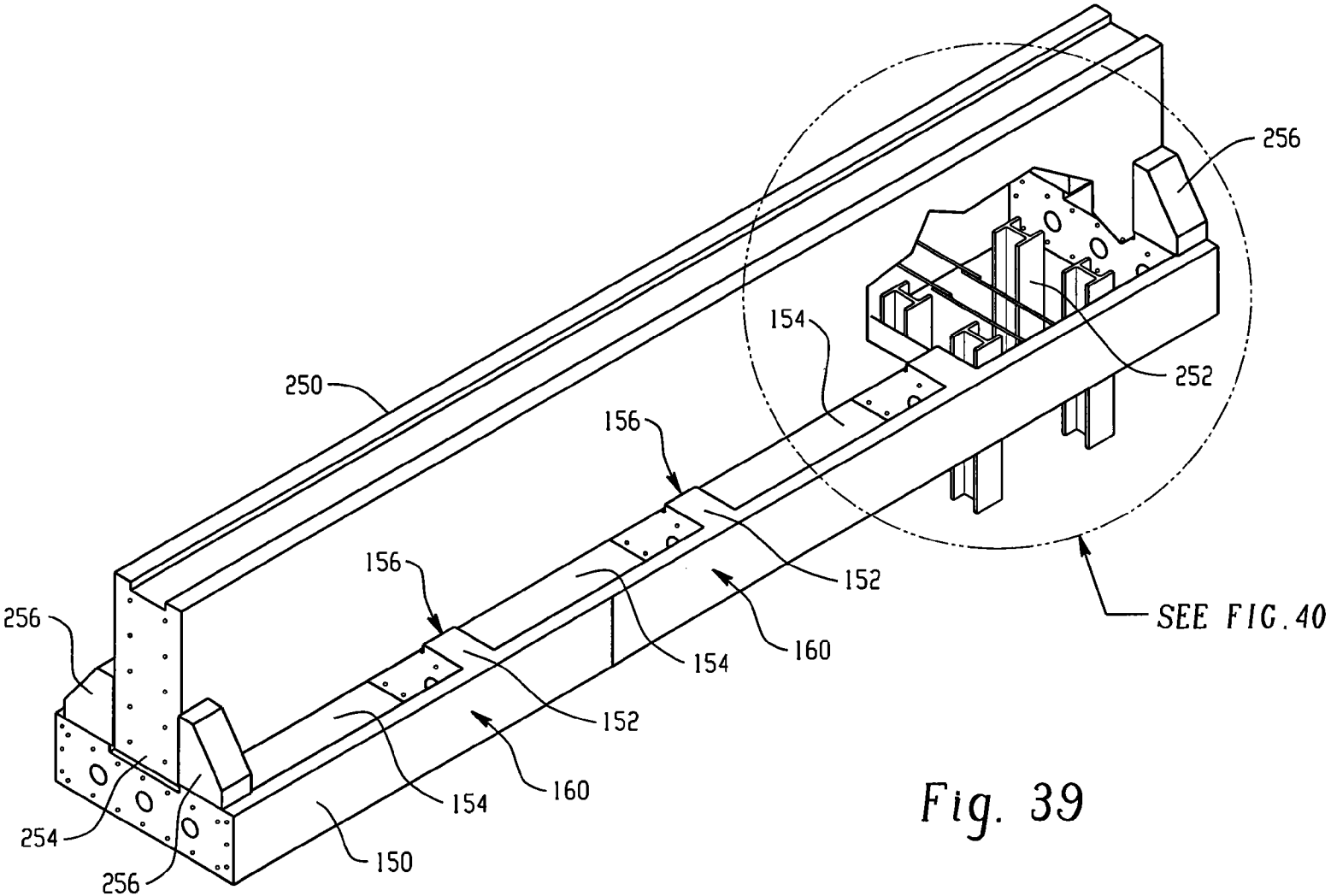
FIGS. 39-41 show another embodiment of a pedestal arrangement.
Figure 40:
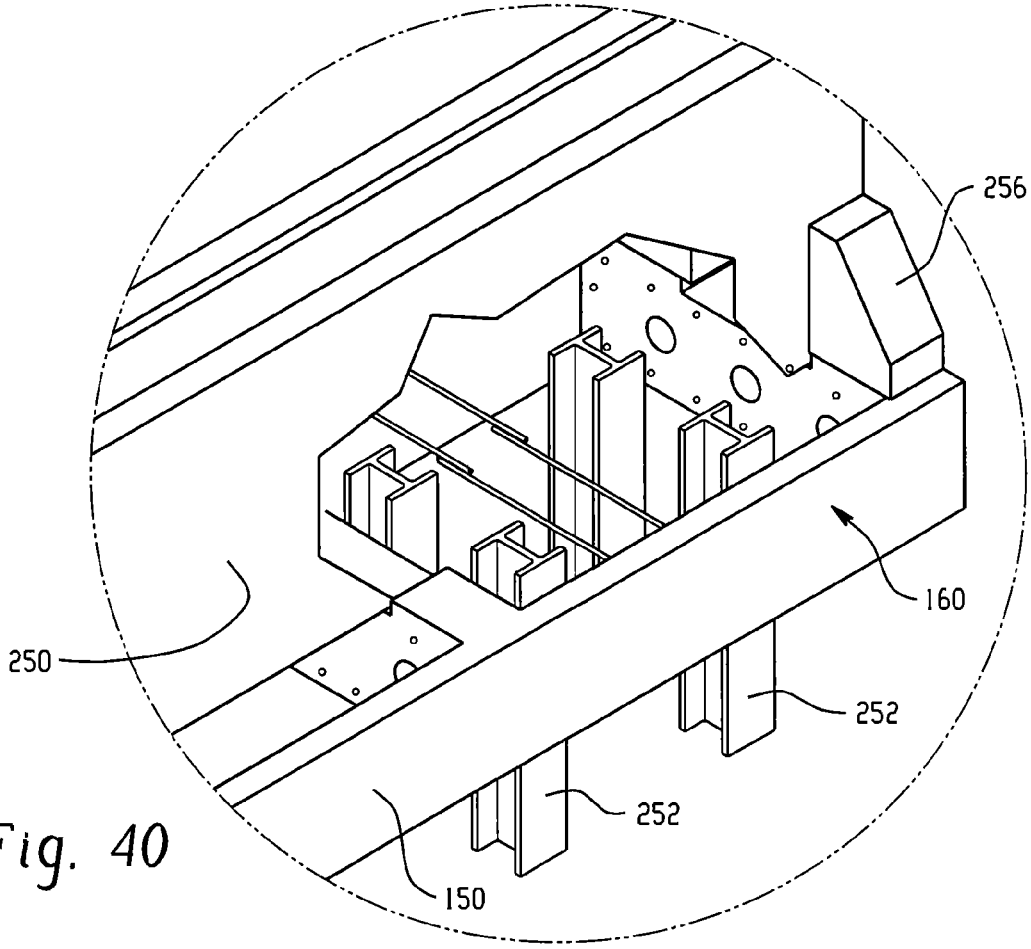
Figure 41:
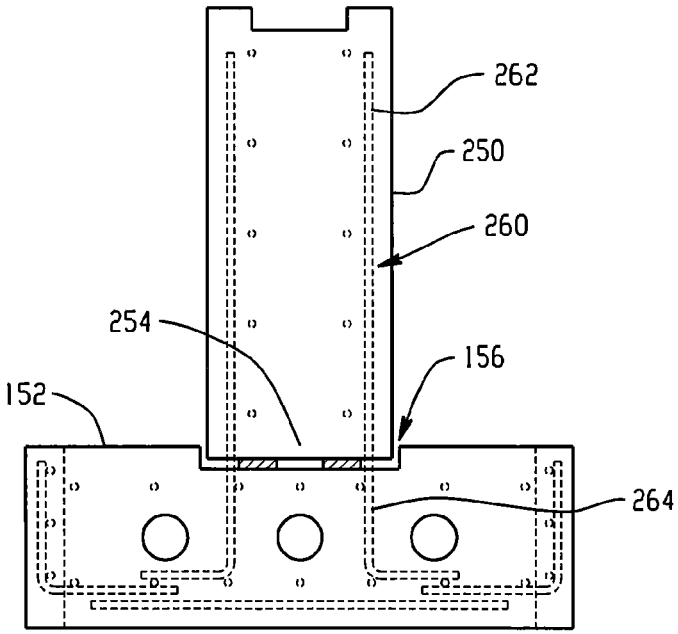

Referring now to FIGS. 39-41, a foundation unit structure utilizing precast concrete foundation units 160 and a precast pedestal 250 is shown, along with piles 252. In this embodiment, the pedestal unit 250 includes a central bottom portion 254 that seats within the recesses 156 of the cross-member supports 152, and integrated side supports 256 that rest on the upper surfaces of the cross-member supports 152, and in the illustrated embodiment partly on the upper surfaces of the elongated upright sidewalls 150, to provide lateral support to the pedestal. In the illustrated embodiment, side supports 256 are provided only at the ends of the pedestal unit 250, but the side supports could also be provided elsewhere along the length of the pedestal unit. As described above for other embodiments, cast-in-place concrete poured at the use location and within the cells 154 of the unit 160 embeds the bottom of the pedestal unit 250 and integrates the precast pedestal unit 250 with to precast foundation unit 160 to form an integrated foundation structure. In this regard, and as best shown in FIG. 41, reinforcement 260 having a part 262 extending within the pedestal unit 250 and a part 264 extending out of the bottom of the pedestal unit into the cast-in-place concrete aids in the integration. The cast-in-place concrete also ties the precast concrete foundation unit 160 to the piles 252.

In the case of each embodiment of the precast concrete foundation units 16, 160 and 200 described above, it is noted that such foundation units have spaced apart elongated upright wall members to define a channel therebetween, and multiple upright supports located within the channel. In the illustrated embodiments of precast concrete foundation units 16, the units have a bottom wall and the supports extend upward from the bottom wall. In the illustrated embodiments of foundation units 160 and 200 the units have no bottom wall and the supports extend between and connect the elongated upright wall members. In the case of all embodiments, when installed at the final use site the multiple supports of one precast concrete foundation unit (e.g., supporting one side of a bridge structure) should typically substantially align with the multiple supports of the another, substantially parallel precast concrete foundation unit (e.g., supporting the opposite side of the bridge structure). The elongated upright wall members may have the same height (e.g., as in the illustrated embodiments of units 16 and 160) or the elongated upright wall members may have different heights (e.g., as in the illustrated embodiment of unit 200). The top recesses of the supports, when present, may be located entirely within the channel of the unit (e.g., as in some of the illustrated embodiments of units 16 and in the illustrated embodiments of units 160), or the recesses may be extend from the channel to one of the elongated walls (e.g., as shown in the illustrated embodiment of units 200).

Figure 36:
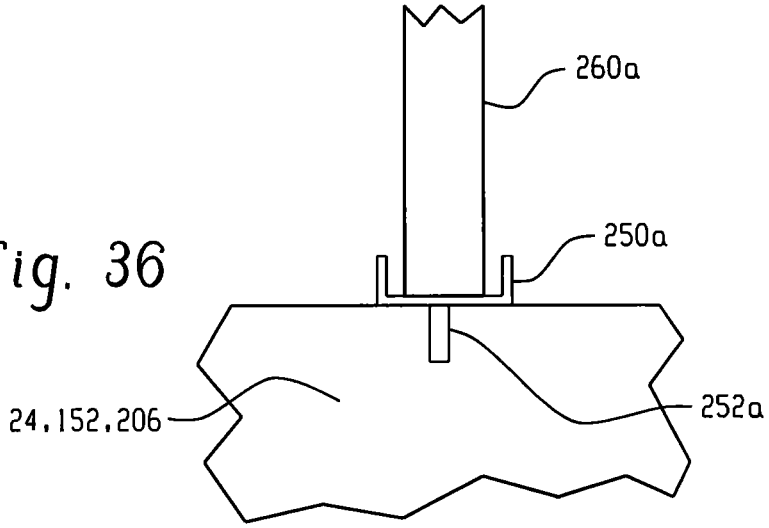
FIGS. 36-38 show alternative embodiments of supports of precast concrete foundation units.
Figure 37:
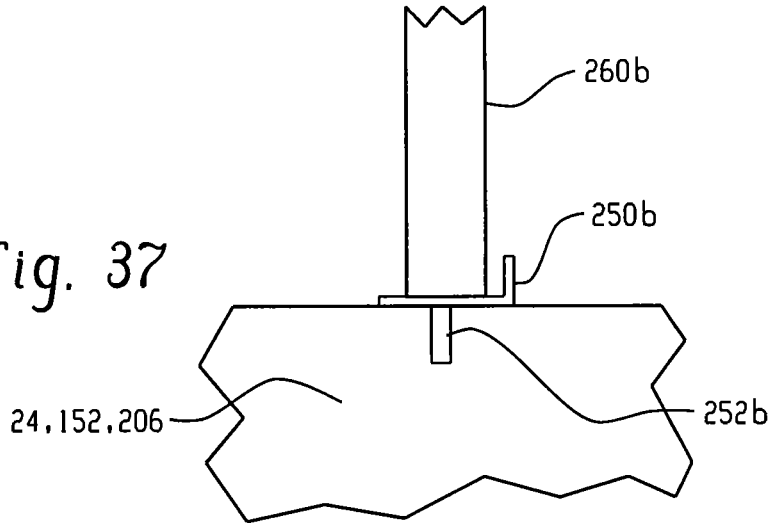
Figure 38:
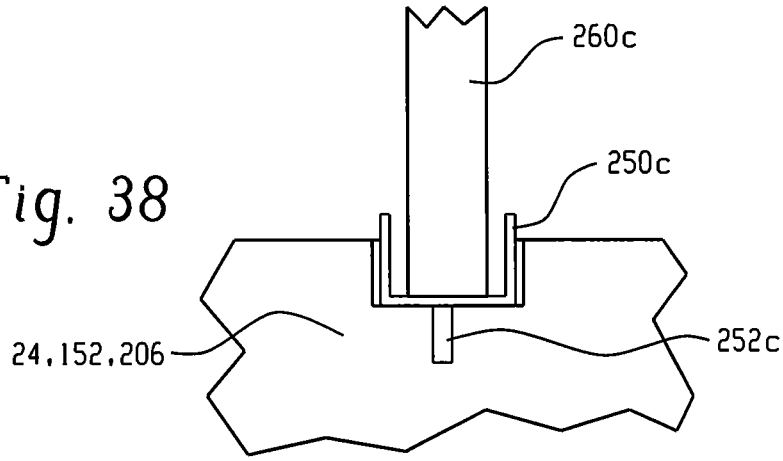

As reflected by the described embodiments, supports of the precast foundation units may in some cases have recesses and in other cases not have recesses. Moreover, other embodiments may utilize channel members that are mounted to the supports. For example, referring to FIGS. 36-38, embodiments of supports 24, 152, 206 having a channel member 250*a*, 250*b*, 250*c* mounted thereon are shown, with the channel member receiving the bottom portion 260*a*, 260*b*, 260*c* of a bridge unit. The channel member may be mounted to the support using any suitable attachment structure 252*a*, 252*b*, 252*c* (e.g., bolt(s) or other anchor(s)). In other embodiments the channel member itself may be partly embedded in the precast concrete or may be secured by a construction adhesive. As shown, the channel member may take on various shapes (e.g., U-shaped, L-shaped or an irregular shape). The channel member may typically be of metal plate construction (e.g., U-channel or L-channel), but other materials may be used. Regardless of the exact material or configuration of the channel member 250*a*, 250*b*, 250*c*, the channel member acts to receive and support the bottom portion of the bridge units, in a similar manner to the recesses described above. Both the recesses and the channel members are examples of "receiving channels" for the bottom portions of the bridge units. Shims may be used in combination with receiving channels as well (e.g., between the receiving channel and the bottom surface of the bridge unit side).

Where precast concrete wingwall foundation units 54 are used in combination with the foundation units 16, 160, 200, embedded reinforcement may typically be used to lock the wingwall foundation units 54 to the foundation units 16, 160, 200 to provide a rigid, integrated structure. Cast-in-place concrete provides at least part of the embedment of the reinforcement. In some examples the cast-in-place concrete embedment may be in the concrete poured in the channel of the foundation units 16, 160, 200 and in other examples the cast-in-place concrete embedment may be in an end channel of the wingwall foundation unit 56. In either case, part of the reinforcement may be embedded in part of the precast concrete before the final embedment in the cast-in-place concrete is achieved. For example, in one implementation a first portion of the reinforcement is embedded in the precast concrete and has a surface exposed/accessible internally threaded socket end to which a second reinforcement portion is threadedly connected after curing of the concrete, such that, the first portion is embedded and the second portion initially protrudes. In another example, a continuous unitary piece of reinforcement has one part embedded in the precast concrete and one part protruding from the precast concrete.

The combination precast and cast-in-place concrete foundation structures described herein can be utilized to support virtually any type bridge structure. Moreover, other types of structures could be supported as well. On-site time and expense associated with foundation placement is reduced (e.g., the need for form placement and much of the reinforcement placement is eliminated).

It is to be clearly understood that the above description is intended by way of illustration and example only and is not intended to be taken by way of limitation, and that changes and modifications are possible. For example, the subject foundation system and method could be adapted for other types of applications, such pile caps or caps for other deep foundations. Accordingly, other embodiments are contemplated and modifications and changes could be made without departing from the scope of this application.

What is claims is:

1. A precast concrete foundation unit for use in constructing a combination precast and cast-in-place concrete foundation structure, the precast concrete foundation unit comprising:

a first elongated upright wall member and a second elongated upright wall member spaced apart from the first elongated upright wall member to define a channel therebetween, and multiple upright supports located within the channel, each of the multiple upright supports extends laterally between the first elongated upright wall member and the second elongated upright wall member of the first precast concrete foundation unit to (i) define multiple spaced apart cells along a length of the channel and (ii) rigidly connect the first elongated upright wall member and the second elongated upright wall member, each of the multiple cells is open at both the top and the bottom, a receiving channel is located atop each of the multiple upright supports;

wherein bottom surfaces of each of the inner elongated upright wall member, the outer elongated upright wall member and the multiple upright supports of the first precast concrete foundation unit lie in a common plane;

at least some of the multiple upright supports include at least one flow opening extending from cell to cell for permitting cast-in-place concrete to flow from one cell through the upright support to another cell during pouring, wherein the flow opening is spaced above the bottom surface of the support and below a top surface of the support so as to be completely surrounded by precast concrete of the upright support.

2. The precast concrete foundation unit of claim 1 wherein the receiving channel of each of the multiple upright supports extends laterally from within the channel to the first elongated upright wall member.

3. The precast concrete foundation unit of claim 2 wherein the second elongated upright wall member has a height that is greater than a height of the first elongated upright wall member.

4. The precast concrete foundation unit of claim 1 wherein the receiving channel of each of the multiple upright supports is located entirely within the channel.

5. The precast concrete foundation unit of claim 1 wherein each receiving channel is one of (i) a recess formed in the top of its respective upright support or (ii) a channel member mounted to the top of its respective upright support.

6. A combination precast and cast-in-place concrete foundation structure incorporating the precast concrete foundation unit of claim 1 located at a bridge installation site, comprising:

cast-in-place concrete within the channel of the precast concrete foundation unit and tied to each of the first and second elongated upright wall members by reinforcement embedded within both the cast-in-place concrete and the first elongated upright wall member and reinforcement embedded within both the cast-in-place concrete and the second elongated upright wall member, the cast-in-place concrete substantially closes each cell from top to bottom, and cast-in-place concrete is located within flow openings of the upright supports.

7. The structure of claim 6 wherein:

at least some of the multiple upright supports of the precast concrete foundation unit further include multiple reinforcement passages from cell to cell, with reinforcement passing through the reinforcement passages from cell to cell and embedded within the cast-in-place concrete.

8. A method of constructing a combination precast and cast-in-place concrete foundation structure utilizing at least one precast concrete foundation unit according to claim 1, comprising:

receiving at a construction site a first precast concrete foundation unit according to claim 1;

placing the first precast concrete foundation unit at a desired use location of the construction site;

delivering concrete into the cells of the first precast concrete foundation unit while the first precast concrete foundation unit remains at the desired use location;

allowing the concrete to cure-in-place.

9. The method of claim 8 wherein one of a precast concrete pedestal unit or a bridge unit is supported at least in part within the channel on the multiple upright supports prior to delivering concrete into the cells of the first precast concrete foundation unit, and during the step of allowing the concrete to cure-in-place, a bottom portion of the one of the precast concrete pedestal unit or the bridge unit becomes embedded in the cured-in-place concrete.

10. The method of claim 9 wherein each of the multiple upright supports includes a top recess therein or channel member thereon and the one of the precast concrete pedestal unit or the bridge unit is supported by the top recess or channel member.

11. A method of constructing a combination precast and cast-in-place concrete foundation structure, the method comprising:

receiving at a construction site a first precast concrete foundation unit comprising:

a first elongated upright wall member and a second elongated upright wall member spaced apart from the first elongated upright wall member to define a channel therebetween, and multiple upright supports located within the channel, each of the multiple upright supports extends laterally between the first elongated upright wall member and the second elongated upright wall member of the first precast concrete foundation unit to (i) define multiple spaced apart cells along a length of the channel and (ii) rigidly connect the first elongated upright wall member and the second elongated upright wall member, each of the multiple cells is open at both the top and the bottom, a receiving channel is located atop each of the multiple upright supports, at least some of the multiple upright supports include at least one flow opening extending from cell to cell for permitting cast-in-place concrete to flow from one cell through the support to another cell during pouring, wherein the flow opening is spaced from both a top and a bottom of the upright supports;

placing the first precast concrete foundation unit at a desired use location of the construction site;

delivering concrete into the cells of the first precast concrete foundation unit while the first precast concrete foundation unit remains at the desired use location;

allowing the concrete to cure-in-place, receiving at the construction site a precast concrete wingwall foundation unit;

prior to the delivering step, placing the precast concrete wingwall foundation unit at one end of the first precast concrete foundation unit such that reinforcement extends from the precast concrete wingwall foundation unit and into the channel;

as a result of the delivering and allowing steps, the reinforcement that extends from the precast concrete wingwall foundation unit and into the channel becomes embedded in the cured-in-place concrete.

12. The method of claim 11 wherein the precast concrete wingwall foundation unit includes a bottom surface and a top surface, the bottom surface wider than the top surface.

13. A precast concrete foundation unit for use in constructing a combination precast and cast-in-place concrete foundation structure, the precast concrete foundation unit comprising:

a first elongated upright wall member and a second elongated upright wall member spaced apart from the first elongated upright wall member to define a channel therebetween, and multiple upright supports located within the channel, each of the multiple upright supports extends laterally between the first elongated upright wall member and the second elongated upright wall member to (i) define multiple spaced apart cells along a length of the channel and (ii) rigidly connect the first elongated upright wall member and the second elongated upright wall member, each of the multiple cells is open at both the top and the bottom;

wherein the second elongated upright wall member has a top surface with a height that is greater than a height of a top surface the first elongated upright wall member, wherein each upright support has a top surface with an uppermost portion and a recessed portion, the uppermost portion vertically adjacent to and extending laterally from the top surface of the second elongated upright wall member, and the recessed portion vertically adjacent to and extending laterally from the top surface of the first elongated upright wall member.

14. A method of constructing a combination precast and cast-in-place concrete foundation structure, the method comprising:

utilizing a first precast concrete foundation unit comprising:

a first elongated upright wall member and a second elongated upright wall member spaced apart from the first elongated upright wall member to define a channel therebetween, and multiple upright supports located within the channel, each of the multiple upright supports extends laterally between the first elongated upright wall member and the second elongated upright wall member of the first precast concrete foundation unit to (i) define multiple spaced apart cells along a length of the channel and (ii) rigidly connect the first elongated upright wall member and the second elongated upright wall member, each of the multiple cells is open at both the top and the bottom, at least some of the multiple upright supports include at least one flow opening extending from cell to cell for permitting cast-in-place concrete to flow from one cell through the support to another cell during pouring;

placing the first precast concrete foundation unit at a use location of a construction site;

delivering concrete into the cells of the first precast concrete foundation unit while the first precast concrete foundation unit remains at the use location;

allowing the concrete to cure-in-place;

prior to the delivering step, placing a precast concrete wingwall foundation unit at one end of the first precast concrete foundation unit, with reinforcement extending from the precast concrete wingwall foundation unit and into the channel;

as a result of the delivering and allowing steps, the reinforcement that extends from the precast concrete wingwall foundation unit and into the channel becomes embedded in the cured-in-place concrete.

15. The method of claim 14 wherein the precast concrete wingwall foundation unit includes a bottom surface and a top surface, the bottom surface wider than the top surface.

16. A method of constructing a combination precast and cast-in-place concrete foundation structure, the method comprising:

utilizing a first precast concrete foundation unit comprising:

a first elongated upright wall member and a second elongated upright wall member spaced apart from the first elongated upright wall member to define a channel therebetween, and multiple upright supports located within the channel, each of the multiple upright supports extends laterally between the first elongated upright wall member and the second elongated upright wall member of the first precast concrete foundation unit to (i) define multiple spaced apart cells along a length of the channel and (ii) rigidly connect the first elongated upright wall member and the second elongated upright wall member, a receiving channel is located atop each of the multiple upright supports, wherein each receiving channel is formed by a recessed portion of the upright support that is downwardly offset from an uppermost surface portion of the upright support;

placing the first precast concrete foundation unit at a use location of a construction site;

supporting one of a precast concrete pedestal unit or a bridge unit at least in part within the receiving channel on the multiple upright supports, wherein a bottom portion of the pedestal unit or bridge unit is located within the recessed portion defining the receiving channel;

delivering concrete into the cells of the first precast concrete foundation unit while the first precast concrete foundation unit remains at the use location and while the bottom portion of the pedestal unit or bridge unit is located within the recessed portion;

allowing the concrete to cure-in-place such that the bottom portion of the pedestal unit or the bridge unit becomes embedded in the cured-in-place concrete.

* * * * *